US007605680B2

(12) United States Patent
Matsumoto et al.

(10) Patent No.: US 7,605,680 B2
(45) Date of Patent: Oct. 20, 2009

(54) ELECTROMAGNETIC ACTUATOR

(75) Inventors: Yasuhiro Matsumoto, Niiza (JP); Nobutaka Kubota, Tokyo (JP); Takeshi Noda, Tokyo (JP); Kazuhiro Matsuo, Tokyo (JP); Kenji Kato, Tokyo (JP); Mitsutaka Homma, Tokorozawa (JP); Takao Wakabayashi, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 139 days.

(21) Appl. No.: 11/661,606

(22) PCT Filed: Sep. 7, 2005

(86) PCT No.: PCT/JP2005/016409

§ 371 (c)(1),
(2), (4) Date: Mar. 1, 2007

(87) PCT Pub. No.: WO2006/028126

PCT Pub. Date: Mar. 16, 2006

(65) Prior Publication Data

US 2007/0257756 A1 Nov. 8, 2007

(30) Foreign Application Priority Data

Sep. 7, 2004 (JP) ..... 2004-260142
Feb. 25, 2005 (JP) ..... 2005-051702

(51) Int. Cl.
*H01F 7/00* (2006.01)

(52) U.S. Cl. ..... 335/229; 335/12; 335/103; 335/183; 335/220; 335/230; 335/232; 335/234; 335/238; 335/249; 335/261; 335/262; 335/270; 335/274; 335/279; 335/280; 335/281; 335/282; 335/295; 335/297

(58) Field of Classification Search ..... 335/103, 335/183, 12, 295, 297, 220–282
See application file for complete search history.

(56) References Cited

U.S. PATENT DOCUMENTS 3,070,730 A * 12/1962 Gray et al. ..... 335/229
3,119,940 A * 1/1964 Pettit et al. ..... 310/24
3,728,654 A * 4/1973 Tada ..... 335/234
4,046,244 A * 9/1977 Velazquez ..... 400/124.17

(Continued)

FOREIGN PATENT DOCUMENTS

JP 58-008907 U 1/1983

(Continued)

*Primary Examiner*—Elvin G Enad
*Assistant Examiner*—Mohamad A Musleh
(74) *Attorney, Agent, or Firm*—Foley & Lardner LLP

(57) ABSTRACT

A highly efficient electromagnetic actuator which can reduce leakage of the magnetic flux is provided. The electromagnetic actuator comprises a first coil 31, a movable body 2 adapted to move on the central axis of the first coil 31, a first stator 11 covering the top face, bottom face and outer peripheral face of the first coil 31, and a permanent magnet 15 adapted to firmly latch the movable body 2 at one end point of its movable range. A second stator 12 adapted to control the magnetic flux generated from the permanent magnet 15 is provided in succession with the first stator 11. By providing the second stator 12, when releasing the movable body 2 from its firmly latched state, the permanent magnet 15 is not inversely excited or demagnetized.

18 Claims, 39 Drawing Sheets

U.S. PATENT DOCUMENTS

| | | | | | |
|---|---|---|---|---|---|
| 4,144,514 | A | * | 3/1979 | Rinde et al. | 335/229 |
| 4,253,493 | A | * | 3/1981 | English | 137/625.18 |
| 4,345,228 | A | * | 8/1982 | Idogaki et al. | 335/222 |
| 5,365,210 | A | * | 11/1994 | Hines | 335/238 |
| 6,199,587 | B1 | * | 3/2001 | Shlomi et al. | 137/625.5 |
| 6,816,048 | B2 | | 11/2004 | Morita et al. | |
| 2004/0113731 | A1 | * | 6/2004 | Moyer et al. | 335/220 |

FOREIGN PATENT DOCUMENTS

| | | | | |
|---|---|---|---|---|
| JP | 64-082606 | A | | 3/1989 |
| JP | 2-035407 | U | | 3/1990 |
| JP | 7-037461 | A | | 2/1995 |
| JP | 7-307217 | A | | 11/1995 |
| JP | 11-031616 | A | | 2/1999 |
| JP | 2002-289430 | A | | 10/2002 |
| JP | 2003308761 | A | * | 10/2003 |

* cited by examiner

Prior Art

ELECTROMAGNETIC ACTUATOR

BACKGROUND OF THE INVENTION

1. Field of the Invention

The present invention relates to an electromagnetic actuator which has no adverse effect on adjacent electronic equipments and electromagnetic members.

2. Background Art

In the past, several structures have been proposed as electromagnetic actuators adapted to maintain attracting force due to permanent magnets.

One example of such electromagnetic actuators includes a stator 1 and a movable body 2 as shown in FIG. 38, in which the stator 1 and movable body 2 are arranged symmetrically about the axis of symmetry and constitute together a magnetic circuit having a substantially E-shaped cross section. In two spaces included in the E-shaped structure, coils 31, 32 are provided respectively, and a magnetized permanent magnet 15 is provided at a projecting portion 14 which is projected along a central line of the structure (e.g., see Patent Document 1).

In FIG. 38, since the width of a first gap 41 is less than the width of a second gap 42, the magnetic flux produced by the permanent magnet 15 flows more in the magnetic circuit including the first gap 41. Thus, magnetic attracting force to be applied leftward is generated in the movable body 2, thereby fixing the movable body 2 at a leftward latched position. When the latched state is released, an electric current is caused to flow in the coils 31, 32 to reduce the magnetic flux in the first gap 41 while increasing the magnetic flux in the second gap 42, thereby generating driving force to move the movable body 2 leftward.

Another electromagnetic actuator, as shown in FIG. 39, includes a coil 3, a movable body 2 adapted to move on the central axis of the coil 3, and a stator 1 provided to cover the top and bottom faces and outer periphery of the coil 3. In addition, a permanent magnet 15 is disposed in a gap surrounded by the stator 1 and the movable body 2, whereby the movable body 2 can be attracted to the stator 1 due to the magnetic field to be generated by the permanent magnetic 15 (e.g., see Patent Document 2).

In FIG. 39, when the latched state is released, an electric current is caused to flow in the coil 3 to reduce the magnetic flux from the permanent magnet 15. Thus, the attracting force downwardly applied to the movable body 2 is reduced, thereby releasing the latched state. Accordingly, the movable body 2 rises due to a load.

Patent Document 1: TOKUKAIHEI No. 7-37461, KOHO

Patent Document 2: TOKUKAI No. 2002-289430, KOHO

In the electromagnetic actuator described in the Patent Document 1, since the permanent magnet 15 is provided in the magnetic circuit path to be created by the coils 31, 32, the permanent magnet 15 is directly and inversely excited upon releasing the latched state, leading to demagnetization.

In the electromagnetic actuator described in the Patent Document 2, the magnetic flux to be generated from the permanent magnet 15 may tend to leak outside, thus having an adverse effect on adjacent electronic equipments and electromagnetic members.

Generally, the electromagnetic actuator is required to be highly efficient, thus there is a need for reducing the current to be used upon operation as much as possible.

SUMMARY OF THE INVENTION

The present invention was made in light of the above problems, and therefore it is an object of this invention to provide an electromagnetic actuator which has no possibility of demagnetization due to inverse excitation of a permanent magnet caused by the magnetic flux to be generated by coils upon releasing the latched state and which is configured to minimize leakage of the magnetic flux generated from the permanent magnet and has no adverse influence on adjacent electronic equipments and electromagnetic members.

The present invention is an electromagnetic actuator, comprising: a first coil; a cylindrical movable body adapted to move along the central axis of the first coil; a first stator including a first plate member provided on the top face of the first coil, a first hollow plate member provided on the bottom face of the first coil, and a first cylinder covering the outer periphery of the first coil; a permanent magnet adapted to fix securely the cylindrical movable body at an end point of its movement; and a second stator provided in succession with the first stator and adapted to control the magnetic flux of the permanent magnet.

The present invention is the electromagnetic actuator, wherein the second stator includes a second cylinder provided in succession with the first hollow plate member of the first stator, a second hollow plate member provided at one end on the side of the permanent magnet of the second cylinder, and an internal cylinder disposed in the second cylinder.

The present invention is the electromagnetic actuator, wherein the cylindrical movable body includes a plunger, and a projecting plate member projecting radially outward from the plunger, and wherein a receiving portion for receiving the projecting plate member is provided at the internal cylinder.

The present invention is the electromagnetic actuator, wherein the permanent magnet is provided at the first hollow plate member of the first stator, and wherein the second stator includes a cylindrical member having a flange portion abutting the permanent magnet.

The present invention is the electromagnetic actuator, wherein the permanent magnet is provided at the first hollow plate member of the first stator, and wherein the second stator includes a third hollow plate member abutting the permanent magnet.

The present invention is the electromagnetic actuator, wherein a short ring adapted to make the magnetic flux of the permanent magnet short is provided in the vicinity of the permanent magnet.

The present invention is the electromagnetic actuator, wherein a pole piece connected with the first plate member is provided at the center of the first coil.

The present invention is the electromagnetic actuator, wherein the length of the pole piece is set within the range of from a maximum length to reach the center of the first coil to a minimum length shortened by half of the stroke X of the cylindrical movable body as compared to the maximum length.

The present invention is the electromagnetic actuator, wherein the difference between the outer diameter of the cylindrical movable body and the outer diameter of the pole piece is within the range of ±15% of the outer diameter of the cylindrical movable body.

The present invention is the electromagnetic actuator, wherein the difference between the cross section area of the cylindrical movable body and the cross section area of the pole piece is within the range of ±15% of the cross section of the movable body.

The present invention is the electromagnetic actuator, wherein the cylindrical cross section area of the first plate member which has the same diameter as the outer diameter of the cylindrical movable body is the same as or less than twice the cross section area of the cylindrical movable body.

The present invention is the electromagnetic actuator, wherein the cross section area of the first cylinder covering the outer periphery of the first coil is the same as or less than twice the cross section area of the cylindrical movable body.

The present invention is the electromagnetic actuator, wherein the difference between the cross section area of the inner hollow face of the first hollow plate member and the cross section area of the movable body is within the range of ±15% of the cross section area of the inner hollow face of the first hollow plate member.

The present invention is the electromagnetic actuator, wherein the difference between the cross section area of the second stator which is perpendicular to the magnetic flux of the permanent magnet and the cross section area of the permanent magnet is within the range of ±15% of the cross section area of the second stator.

The present invention is the electromagnetic actuator, wherein a gap defined between the first coil and the first stator is 3 mm or less.

The present invention is the electromagnetic actuator, wherein a gap defined between the inner hollow face of the first hollow plate member of the first stator and the outer peripheral face of the cylindrical movable body is within the range of from 3 mm to 5 mm.

The present invention is the electromagnetic actuator, wherein the difference between the cross section area of the projecting plate member of the cylindrical movable body and the cross section area of the plunger is within the range of ±15% of the cross section of the projecting plate member.

The present invention is the electromagnetic actuator, wherein the difference between the cross section area of the projecting plate member of the cylindrical movable body and the cross section area of the inner peripheral face of the receiving portion of the second cylinder is within the range of ±15% of the cross section area of the projecting plate member.

The present invention is the electromagnetic actuator, wherein a gap between the outer peripheral face of the plunger of the cylindrical movable body and the second stator is within the range of from 1 mm to 5 mm.

The present invention is the electromagnetic actuator, wherein a second coil is provided coaxially with the first coil.

The present invention is the electromagnetic actuator, wherein the first coil and the second coil are juxtaposed with each other in the radial direction.

The present invention is an electromagnetic actuator, comprising: a first coil; a cylindrical movable body adapted to move along the central axis of the first coil; a first stator including a first plate member provided on the top face of the first coil, a first hollow plate member provided on the bottom face of the first coil, and a first cylinder covering the outer periphery of the first coil; a permanent magnet adapted to securely latch the cylindrical movable body by forcing it to be attracted to the first stator at its one operational end point; and a second stator provided in succession with the first stator and adapted to control the magnetic flux generated from the permanent magnet; wherein the permanent magnet is located to be near to the movable body when the cylindrical movable body is moved away from the first stator to be in a released end point.

The present invention is the electromagnetic actuator, wherein the second stator includes a second cylinder provided in succession with the first hollow plate member of the first stator, a second hollow plate member provided at one end on the side of the permanent magnet of the second cylinder, and an internal cylinder disposed in the second cylinder.

The present invention is the electromagnetic actuator, wherein the permanent magnet is located to be near to one end on the side of the released end point of the cylindrical movable body when the cylindrical movable body is moved away from the first stator to be in a released end point.

The present invention is the electromagnetic actuator, wherein the cylindrical movable body includes a plunger, and a projecting plate member projecting radially outward from the plunger, and wherein a receiving portion adapted to receive the projecting plate member is provided at the internal cylinder.

The present invention is the electromagnetic actuator, wherein the difference between the thickness of the projecting plate member projecting radially outward from the plunger of the cylindrical movable body and the thickness of the permanent magnet is within the range of ±15% of the thickness of the projecting member.

The present invention is the electromagnetic actuator, wherein the permanent magnet is located to be near to the projecting plate member projecting radially outward from the plunger of the cylindrical movable body when the cylindrical movable body is moved away from the first stator to be in a released end point.

The present invention is the electromagnetic actuator, wherein a space is formed between the first hollow plate member of the first stator and the internal cylinder of the second stator.

The present invention is the electromagnetic actuator, wherein a second coil is provided in a space formed between the first hollow plate member of the first stator and the internal cylinder of the second stator.

DETAILED DESCRIPTION OF THE INVENTION EXAMPLES

First Embodiment

Now, a first embodiment according to the present invention will be described with reference to FIGS. 1 to 7.

Figure 1:
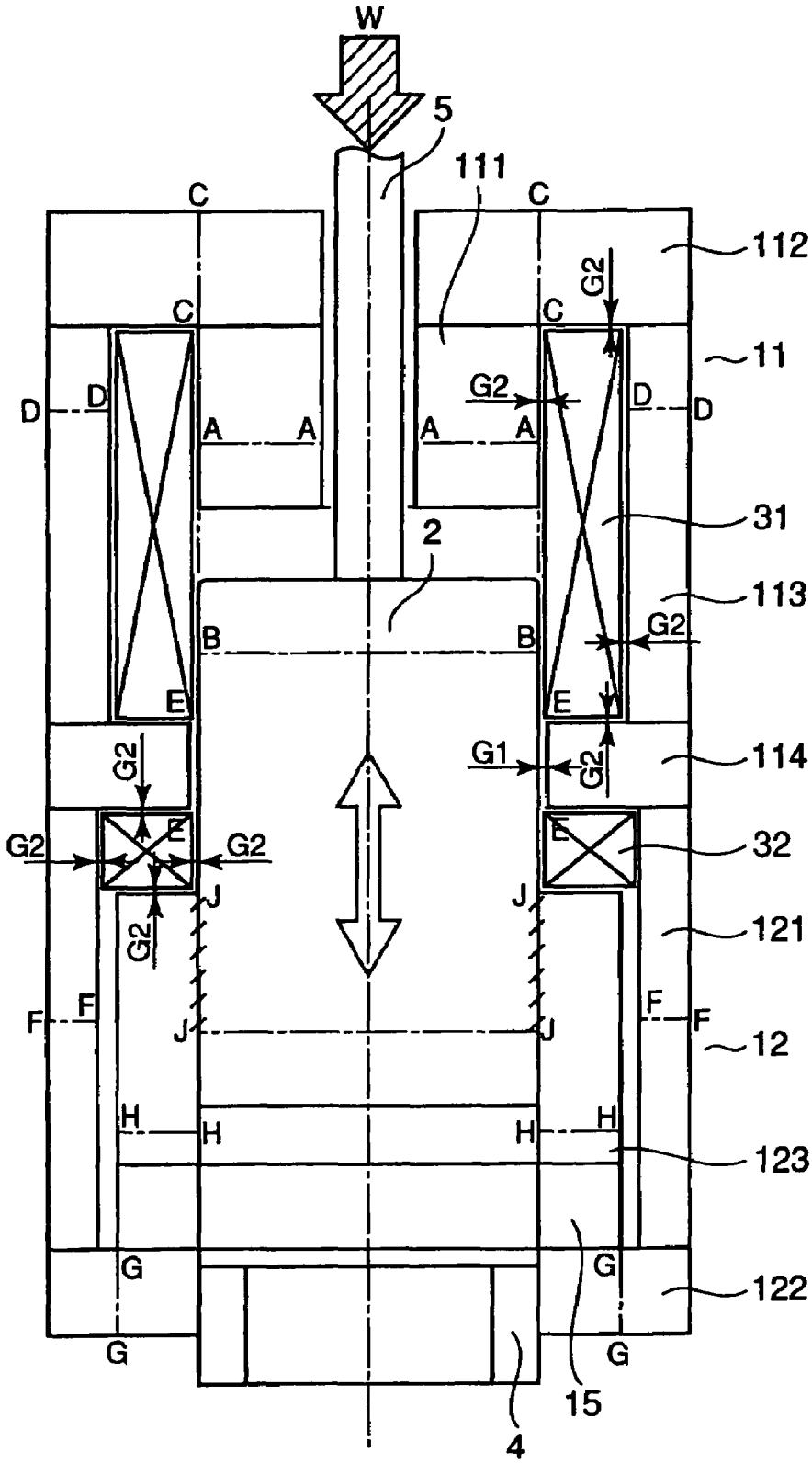
FIG. 1 is a cross section illustrating a first embodiment of an electromagnetic actuator according to the present invention.

FIG. 1 is a cross section of an electromagnetic actuator according to the present invention and shows a latch-released state.

The electromagnetic actuator comprises a first coil 31, a movable body 2 adapted to move on the central axis of the first coil 31, a first stator 11 which is disposed on the top and bottom faces and around the outer periphery as well as inside of the first coil 31 so as to hold the first coil 31 and constitutes, together with the movable body 2, a magnetic circuit for inducing magnetic flux generated from the first coil 31, a ring-shaped permanent magnet 15 which is provided concentrically with the first coil 31 in a position spaced apart from the movable body 2 so as to generate magnetic flux polarized in parallel to the moving direction of the movable body 2, and a second stator 12 connected with the first stator 11 and formed from an electromagnetic material for inducing the magnetic flux generated from the permanent magnet 15 to the movable body 2.

Inside the second stator 12, a second coil 32 is provided concentrically with the first coil 31 in a gap around the periphery of the movable body 2 such that a short ring 4 can slide in the same direction as the movable body 2 in the interior of the second stator 12 due to the effect of a driving mechanism (not shown).

In FIG. 1, the movable body 2 is formed from an electromagnetic material, and is connected with a load W provided to press the movable body 2 downward via a non-magnetic shaft 5 attached to one end of the movable body 2.

The first stator 11 is constructed entirely with electromagnetic components. Namely, the first stator 11 includes a plate member (first plate member) 112 covering the top end face of the first coil 31, a convex pole piece 111 connected with the first plate member 112 and extending near the center of the first coil 31, a cylinder (first cylinder) 113 covering the outer periphery of the first coil 31, and a hollow plate member (first hollow plate member) 114 covering the bottom face of the first coil 31. The pole piece 111 has a maximum length to reach the center of the first coil 31 and a minimum length shortened by half of the stroke X of the movable body 2 as compared to the maximum length, thus the length of the pole piece 111 may be set at a desired length within the range.

The second stator 12 is also constructed entirely with electromagnetic components and includes a cylinder (second cylinder) 121 connected with the first hollow plate member 114 of the first stator 11, a hollow plate member (second hollow plate member) 122 attached to the cylinder 121, and a cylinder (internal cylinder) 123 disposed inside the cylinder 121 and having an inner face 123*a* arranged adjacent to the outer periphery of the movable body 2 with a slight gap defined therebetween. The permanent magnet 15 is fixed between the hollow plate member 122 and the cylinder 123.

Between the first hollow plate member 114 of the first stator 11 and the internal cylinder 123 of the second stator 12, the second coil 32 is provided to surround the movable body 2.

As shown in FIG. 1, the pole piece 111 and the movable body 2 are configured to have the same outer diameter in order to achieve a highly efficient electromagnetic actuator, and as such the cross section area taken along line A-A of the pole piece 111 which is perpendicular to the magnetic flux is substantially the same as the cross section area taken along line B-B of the movable body 2.

As used herein, the term "substantially the same" means that one value has a difference within the range of ±15% as compared to another value. For example, the cylindrical cross section area taken along line C-C of the first plate member 112 and the cross section area taken along line D-D of the cylinder 113 which are perpendicular to the magnetic flux, are substantially the same as or less than twice the cross section area taken along line B-B of the movable body 2.

The cross section area of an inner hollow face E-E of the first hollow plate member 114 is substantially the same as the cross section area taken along line A-A of the pole piece 111. A gap G1 between the inner face of the first hollow plate member 114 and the movable body 2 is properly set at 3 to 5 mm in order to efficiently centralize the magnetic flux generated from the permanent magnet 15, in a latched state, to an attracting face to be defined between the pole piece 111 and the movable body 2. The cross section area taken along line F-F of the second cylinder 121, the cylindrical cross section area taken along line G-G of the second hollow plate member 122, the cross section area taken along line H-H of the internal cylinder 123 and the cross section area of the permanent magnet 15 are substantially the same as the cross section taken along line B-B of the movable body 2, respectively. The area of an opposite face J-J of the internal cylinder 123 is substantially the same as or greater than the cross section taken along line B-B of the movable body 2 when the movable body 2 is in a position near to the pole piece 111.

A gap G2 between the conductor of the first coil 31 or conductor of the second coil 32 and the electromagnetic members 112, 113, 114, 121 or 123 surrounding the coils is set at 3 mm or less in order to efficiently utilize the magnetic flux generated from the respective coils 31, 32.

Next, the operation of this embodiment constructed as described above will be explained.

Figure 2:
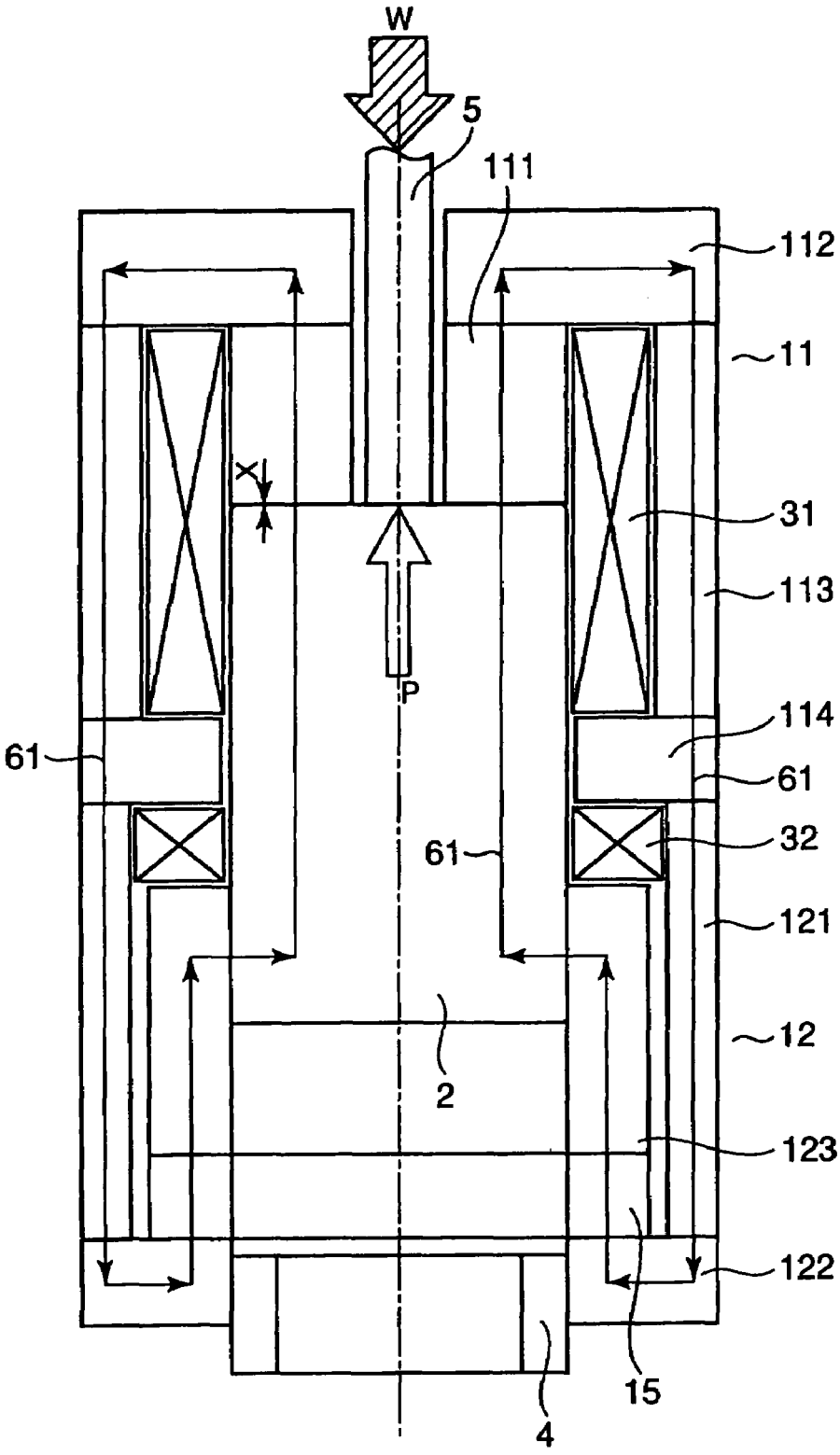
FIG. 2 is a diagram illustrating a movable body which is firmly latched by a permanent magnet in the first embodiment of the present invention.

As shown in FIG. 2, when a gap X between the movable body 2 and the pole piece 111 is zero or quite small, the magnetic flux generated from the permanent magnet 15 forms a magnetic circuit pass defined through the first stator 11, the second stator 12 and the movable body 2, as shown by arrows 61. In this way, attracting force P is applied to the movable body 2 in the direction toward the pole piece 111, and thus the movable body 2 is in a latched state against the load W.

Figure 3:
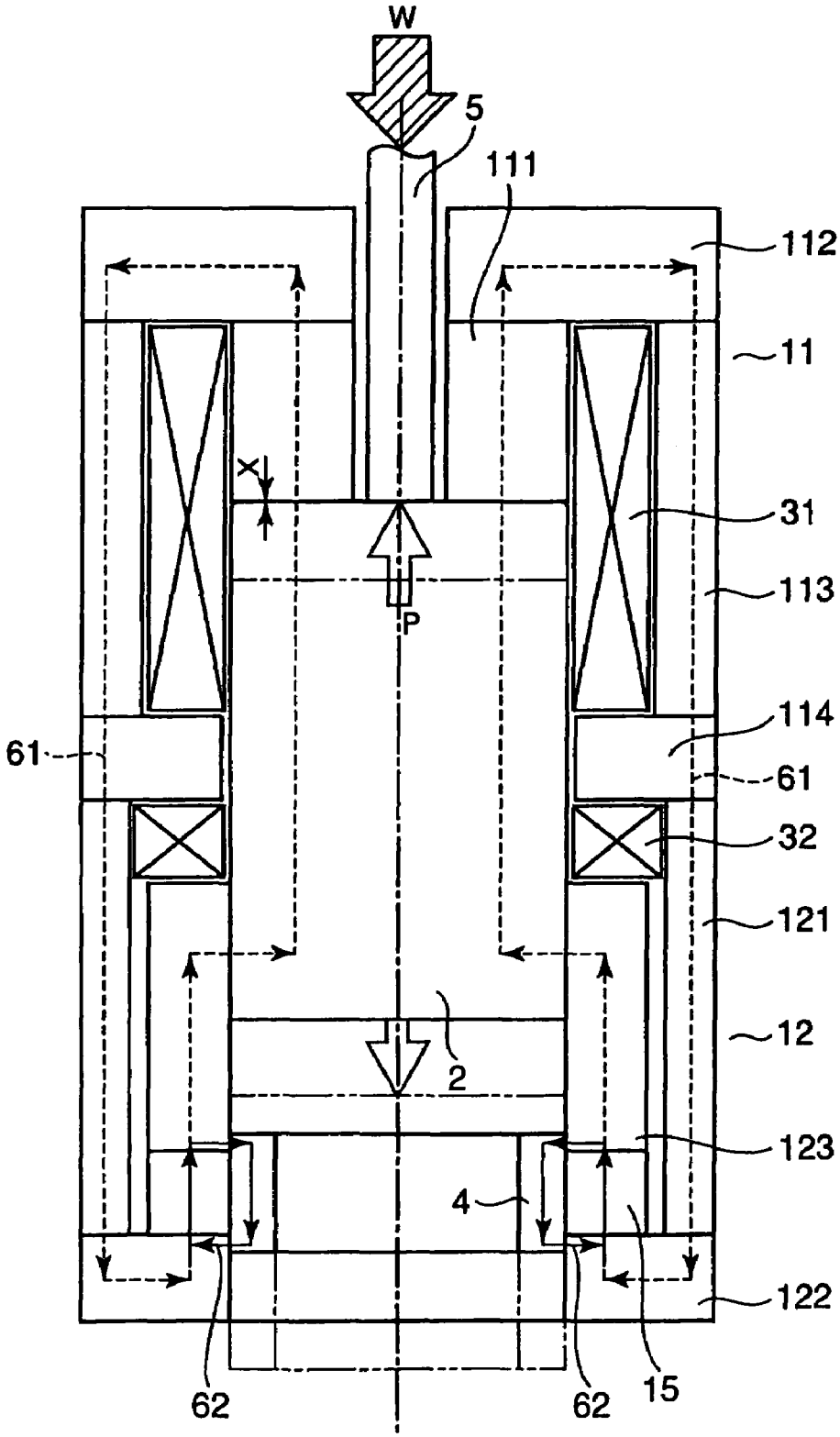
FIG. 3 is a diagram illustrating an operation through which the latched state is released by using a short ring in the first embodiment of the present invention.

In the state shown in FIG. 2, when the short ring 4 slides nearer to the permanent magnet 15, a part of the magnetic flux generated from the permanent magnet 15 is bypassed as shown by arrows 62 in FIG. 3, and as such the magnetic flux between the pole piece 111 and the movable body 2 is reduced, thus the load W will exceed the attracting force P, thereby releasing the movable body 2 from the latched state and lowering the movable body 2.

Figure 4:
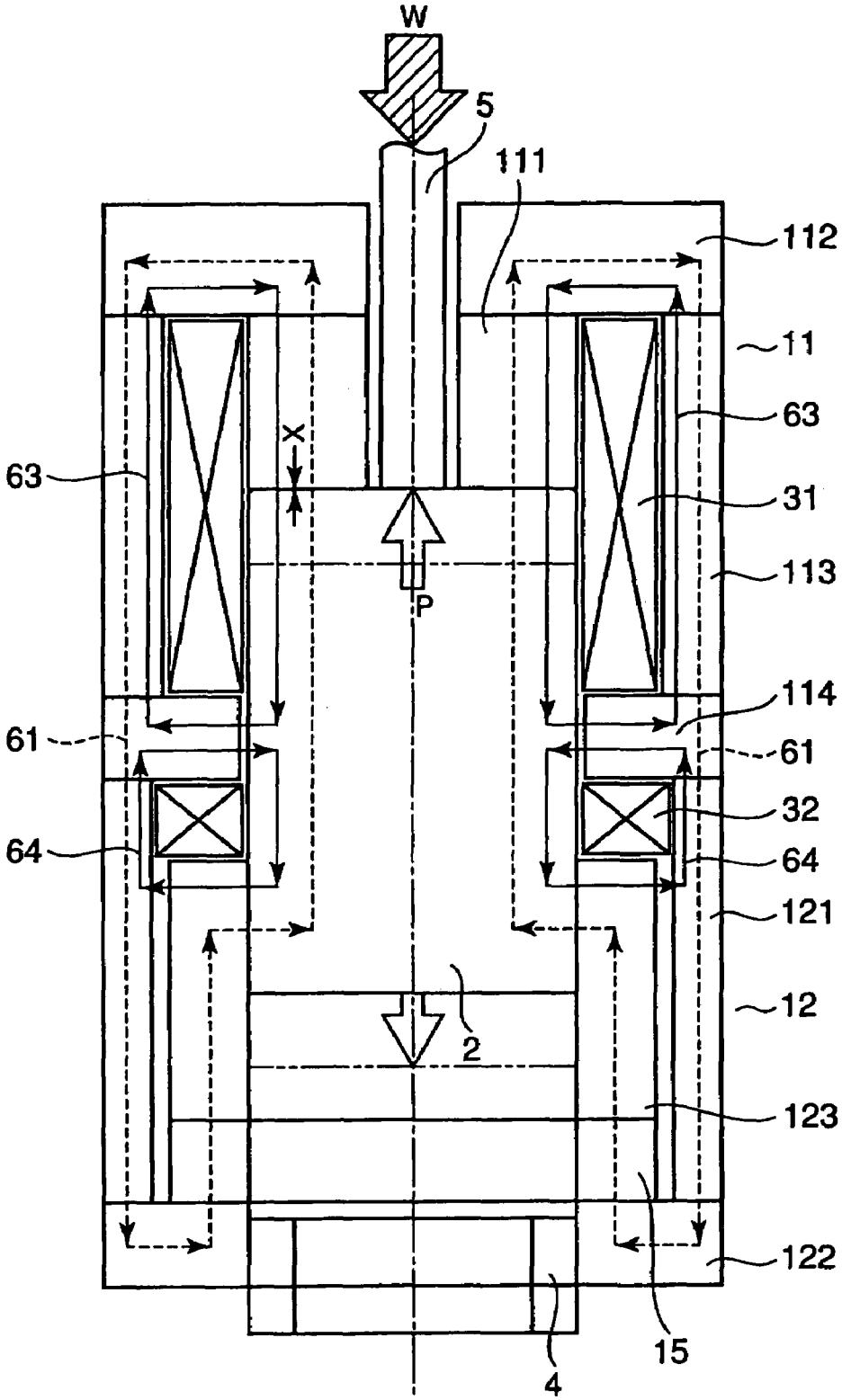
FIG. 4 is a diagram illustrating an operation through which the latched state is released by flowing an electric current through a first and a second coil in the first embodiment of the present invention.

In the state shown in FIG. 2, as shown in FIG. 4, when an electric current is flowed in either one or both of the first coil 31 and second coil 32 to cancel the magnetic flux of the permanent magnet 15, by the effect of magnetic flux shown by arrows 63 to be generated from the first coil 31 and/or by the effect of magnetic flux shown by arrows 64 to be generated from the second coil 32, the magnetic flux 61 generated from the permanent magnet 15 passing through the movable body 2, first stator 11 and second stator 12 is reduced, thus the load W will exceed the attracting force P exerted on the movable body 2, thereby releasing the movable body 2 from the latched state and lowering the movable body 2.

Figure 5:
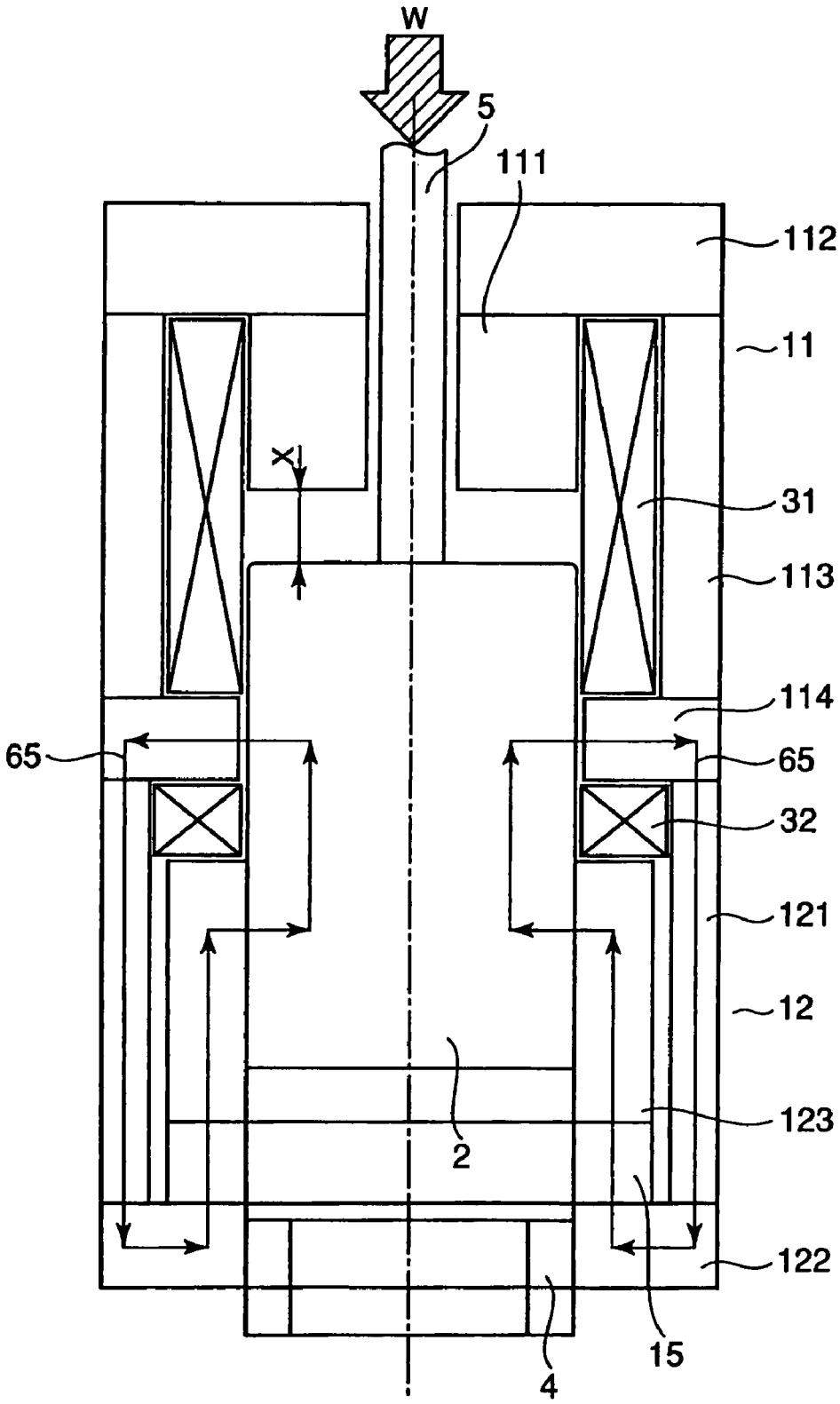
FIG. 5 is a diagram illustrating an electromagnetic actuator in a latch-released state in the first embodiment of the present invention.

As shown in FIG. 5, when the movable body 2, in the latched state, is moved away, by stroke X, from the pole piece 111, since the gap defined between the movable body 2 and the first hollow plate member 114 is smaller than the gap defined between the movable body 2 and the pole piece 111, the magnetic flux from the permanent magnet 15 forms a magnetic circuit pass as shown by arrows 65, thus the attracting force P is no longer exerted on the movable body 2.

Figure 6:
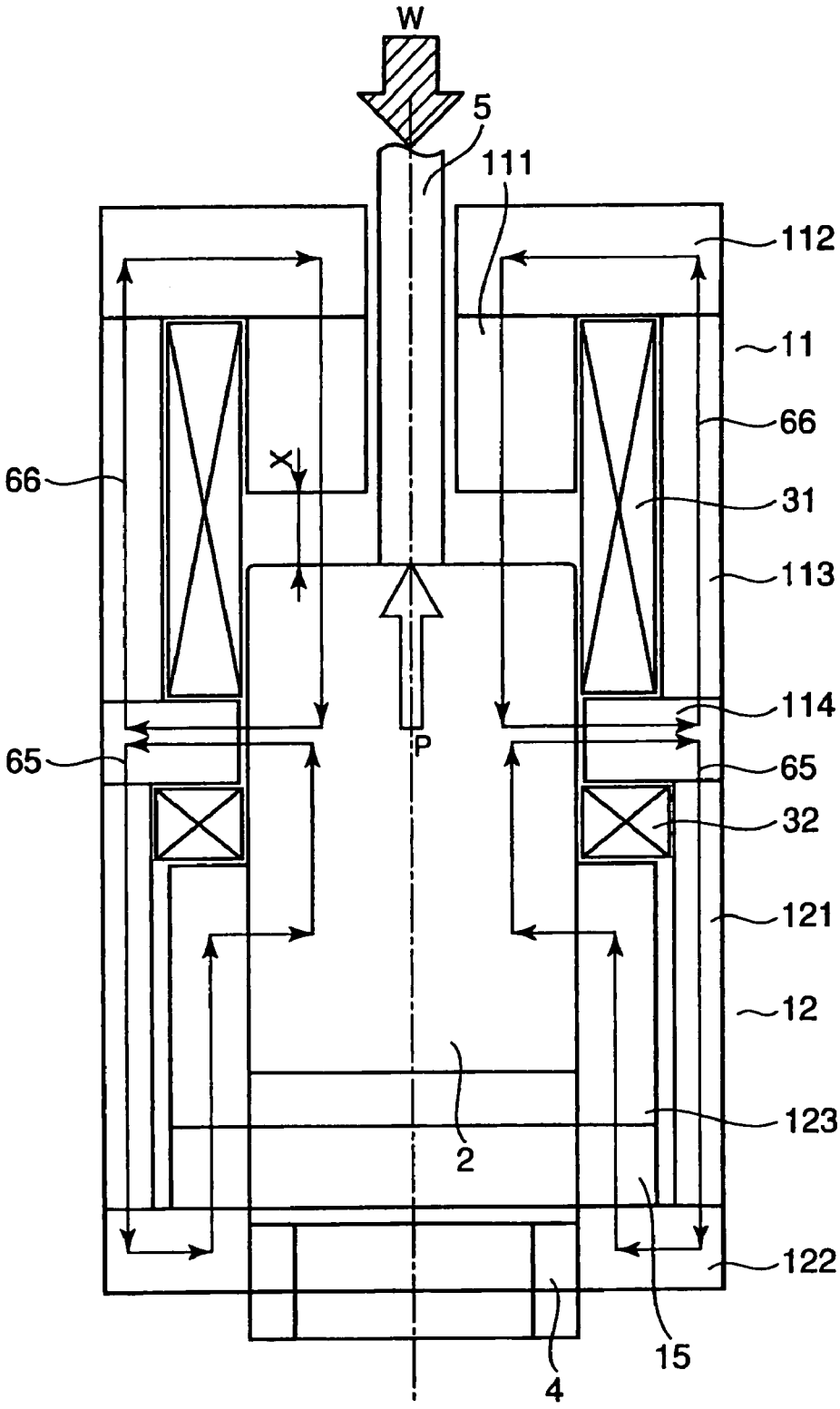
FIG. 6 is a diagram illustrating an operation through which a movable body in a latch-released state is attracted to a pole piece by flowing an electric current through the first coil in the first embodiment of the present invention.
Figure 7:
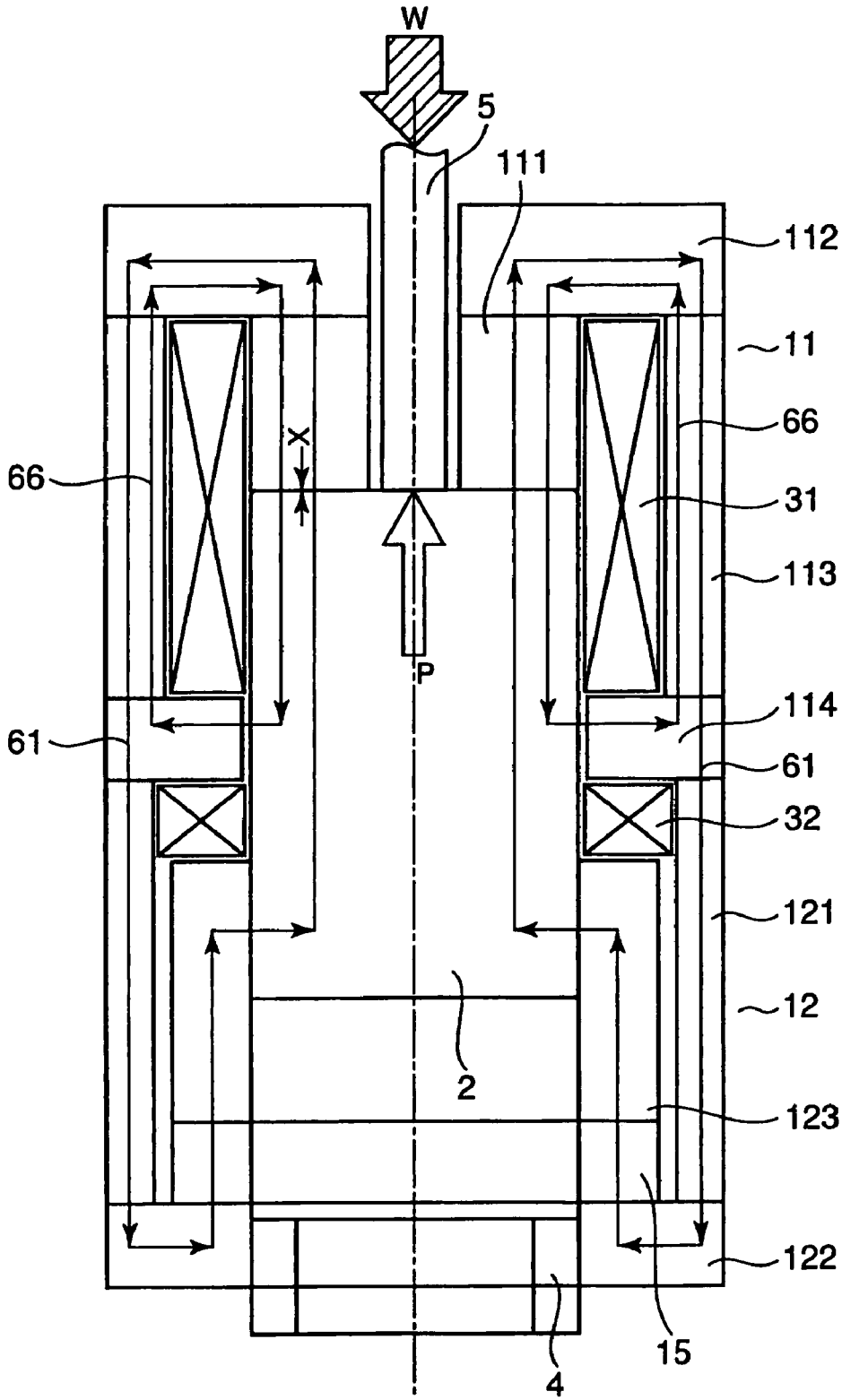
FIG. 7 is a diagram illustrating an operation through which a movable body in a latch-released state is attracted and latched by a pole piece by flowing an electric current through the first coil in the first embodiment of the present invention.
Figure 8:
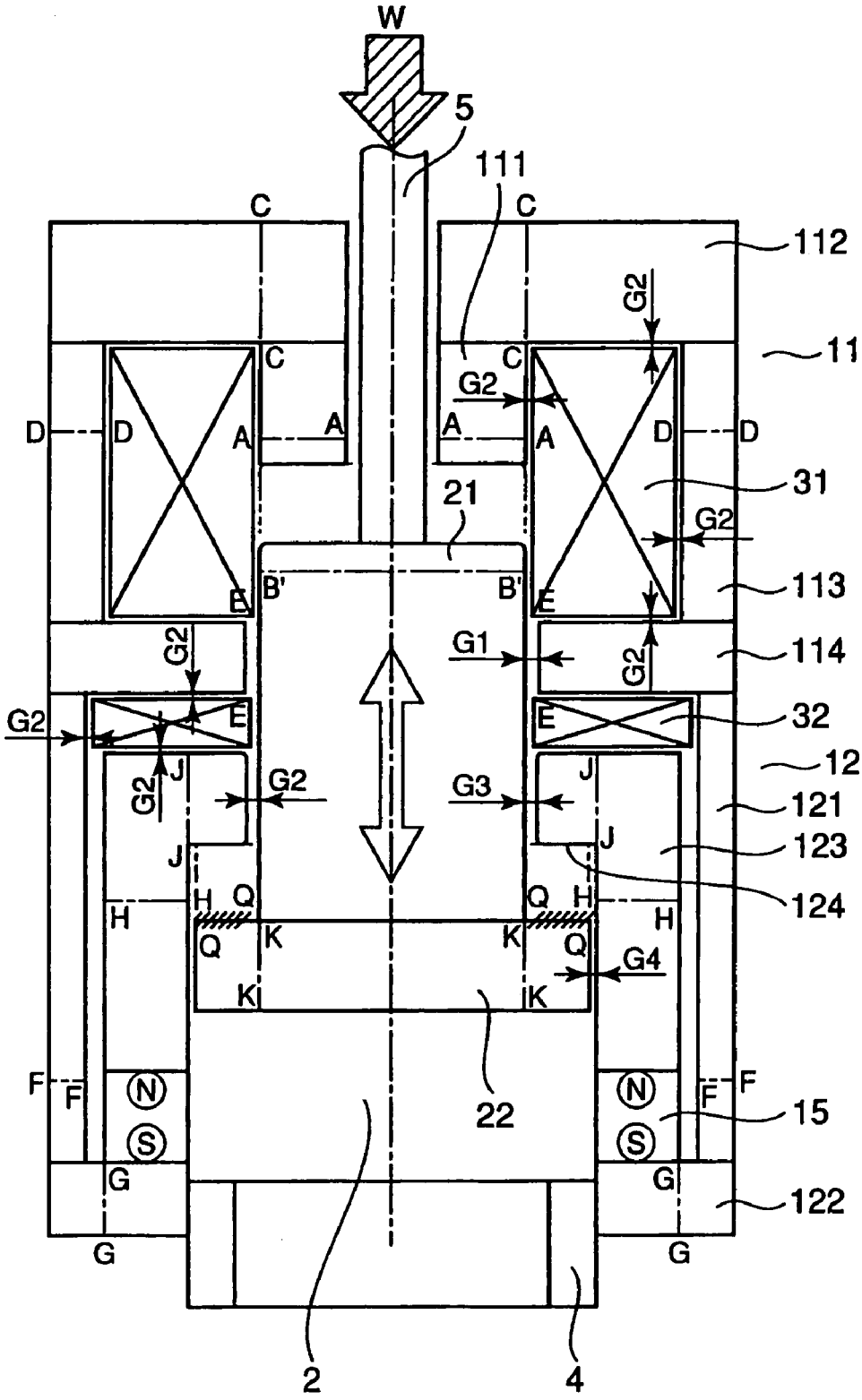
FIG. 8 is a cross section illustrating a second embodiment of an electromagnetic actuator according to the present invention.

As shown in FIG. 6, when magnetic flux is generated in the same direction as the magnetic flux from the permanent magnet 15 by flowing an electric current in the first coil 31, the resultant magnetic flux flows as shown by arrows 66, thus the movable body 2 is attracted toward the pole piece 111. As shown in FIG. 7, in a state where the movable body is completely attracted to the pole piece 111, the magnetic flux from the permanent magnet 15 will be in a state as shown by arrows 61. Thus, even if the electric current does no longer flow in the first coil 31, the movable body 2 remains attracted to the pole piece 111 by the effect of the magnetic flux generated from the permanent magnet 15 as shown in FIG. 2, as such maintaining the latched state.

As described above, according to this embodiment, in either case, the permanent magnet 15 is not inversely excited by the effect of magnetic flux to be generated from the first coil 31 and/or second coil 32. Additionally, since the permanent magnet 15, first coil 31 and second coil 32 are substantially surrounded by the first stator 11, second stator 12 and movable body 2 which are all formed from a ferromagnetic material or materials, the magnetic flux generated is not leaked away.

Second Embodiment

Next, a second embodiment of the present invention will be described with reference to FIGS. 8 to 14.

In the second embodiment shown in FIGS. 8 to 14, like parts in the first embodiment shown in FIGS. 1 to 7 are respectively designated by the same reference numerals or characters, and detailed descriptions for those parts are omitted here.

In FIGS. 8 to 14, the movable body 2 includes a plunger 21 which is formed from a magnetic material and is moved on the central axis of the first coil 31, and a ferromagnetic plate member (projecting plate member) 22 which is provided on the opposite side of the nonmagnetic shaft 5 connected with the load W and projects radially outward from the plunger 21.

Among the components of the second stator 12, while the second cylinder 121 and the hollow plate member 122 have the same constructions as those in the first embodiment respectively, the internal cylinder 123 has a two-stepped cylindrical shape including a receiving portion 124 which forms a stepped portion.

In a latched state, the projecting plate member 22 of the movable body 2 is in contact with the receiving portion 124 of the internal cylinder 123.

In the construction described above, assuming that the north (N) pole is arranged at the top end of the permanent magnet 15 and the south (S) pole is at the bottom end, the S pole appears at the pole piece 111 while the N pole appears at the receiving portion 124 of the internal cylinder 123, thus the movable body 2 is attracted in the latched state by both the N and S poles.

In FIGS. 8 to 14, in order to realize a highly efficient electromagnetic actuator, the pole piece 111 and the plunger 21 are configured to have the same outer diameter, and hence the cross section area taken along line A-A of the pole piece 111 is substantially the same as the cross section area taken along line B'-B' of the plunger 21.

The cylindrical cross section area taken along line C-C of the first plate member 112 and the cross section area taken along line D-D of the first cylinder 113 are substantially the same as or less than twice the cross section area taken along line B'-B' of the plunger 21, respectively. The cross section area of the inner hollow face E-E of the first hollow plate member 114 is substantially the same as the cross section area taken along line A-A of the pole piece 111. The cross section area taken along line F-F of the second cylinder 121, the cylindrical cross section area taken along line G-G of the second hollow plate member 122, the cross section area taken along line H-H of the internal cylinder 123, the cross section area of the permanent magnet 15, the cylindrical cross section area taken along line J-J of the internal cylinder 123, the cylindrical cross section area taken along line K-K of the plate member 22 of the movable body 2, and the area Q-Q over which the projecting plate member 22 will contact with the receiving portion 124 of the internal cylinder 123 are substantially the same as the cross section taken along line B-B of the plunger 21, respectively.

The gap G1 defined between the inner face of the first hollow plate member 114 and the movable body 2 is set at 3 to 5 mm, and the gap G3 defined between the plunger 21 and the internal cylinder 123 and gap G4 between the projecting plate member 22 of the movable body 2 and the internal cylinder 123 are set at 1 to 5 mm, respectively, in order to efficiently centralize the magnetic flux generated from the permanent magnet 15, in a latched state, between the pole piece 111 and the plunger 21 and between the projecting plate member 22 of the movable body 2 and the receiving portion 124 of the internal cylinder 123.

Figure 9:
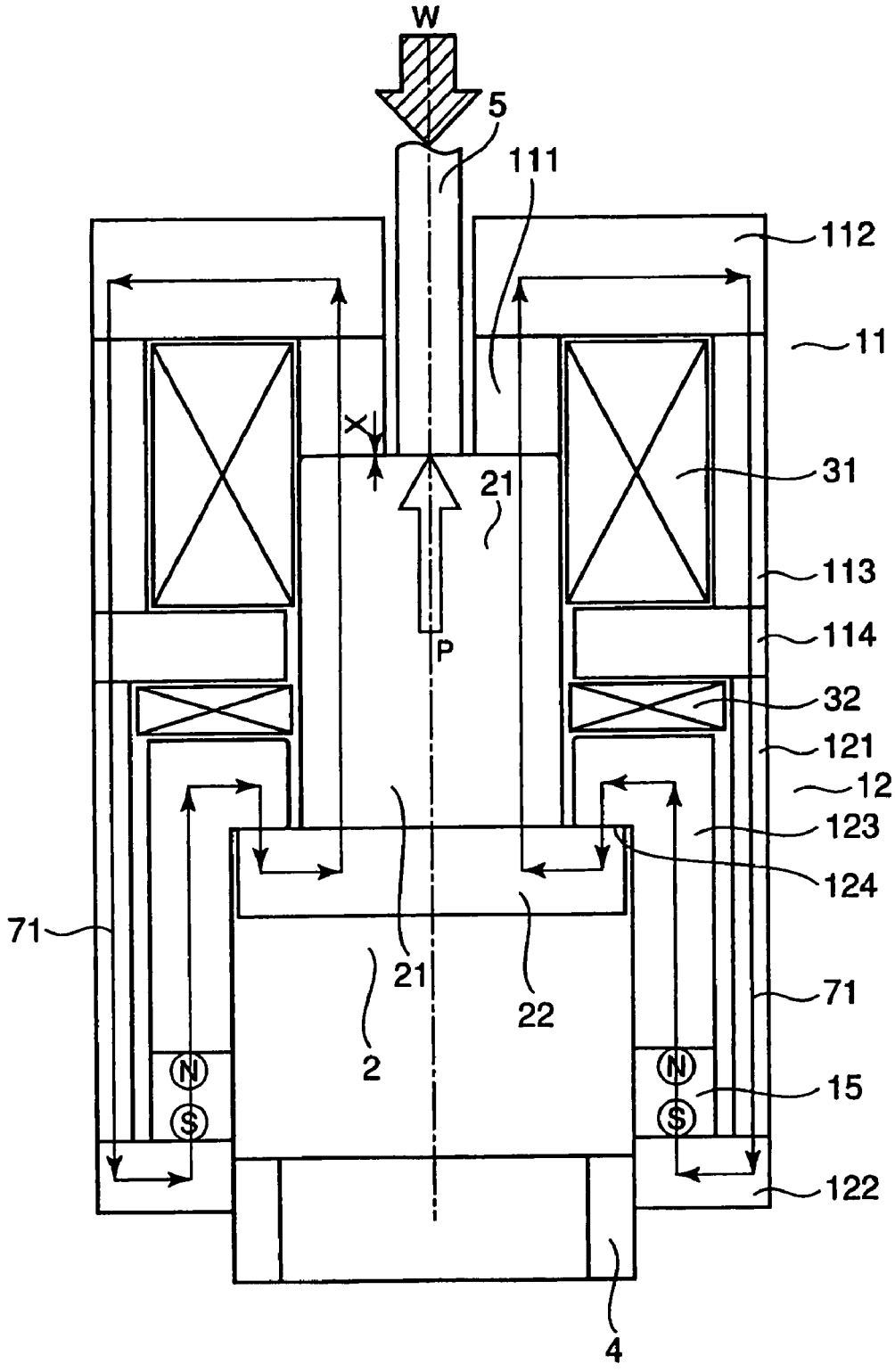
FIG. 9 is a diagram illustrating a movable body which is firmly latched by a permanent magnet in the second embodiment of the present invention.

Next, the operation of this embodiment as constructed above will be described. As shown in FIG. 9, when the gap X defined between the plunger 21 and the pole piece 111 and between the projecting plate member 22 of the movable body 2 and the receiving portion 124 of the internal cylinder 123 is zero or quite small, the magnetic flux generated from the permanent magnet 15 forms a magnetic circuit pass defined through the first stator 11, the second stator 12 and the movable body 2, as shown by arrows 71. In this way, attracting force P is applied to the movable body 2 in the direction toward the pole piece 111, and thus the movable body 2 is in a latched state against the load W.

Figure 10:
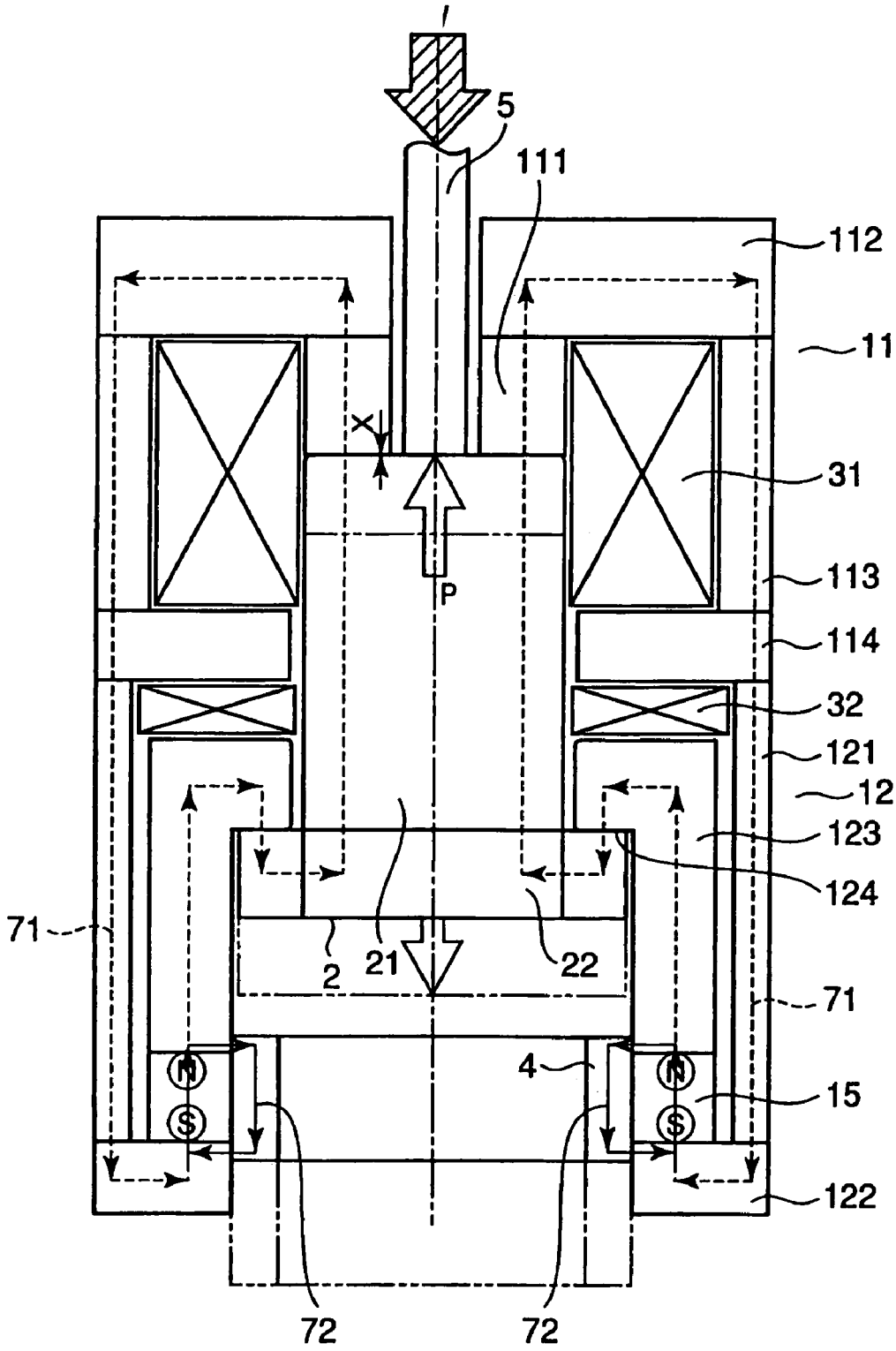
FIG. 10 is a diagram illustrating an operation through which the latched state is released by using a short ring in the second embodiment of the present invention.

In the state shown in FIG. 9, when the short ring 4 slides nearer to the permanent magnet 15, a part of the magnetic flux generated from the permanent magnet 15 is bypassed as shown by arrows 72 in FIG. 10, and as such the magnetic flux between the pole piece 111 and the plunger 21 and between the projecting plate member 22 of the movable body 2 and the receiving portion 124 of the internal cylinder 123 is reduced, thus the load W will exceed the attracting force P, thereby releasing the movable body 2 from the latched state and lowering the movable body 2.

Figure 11:
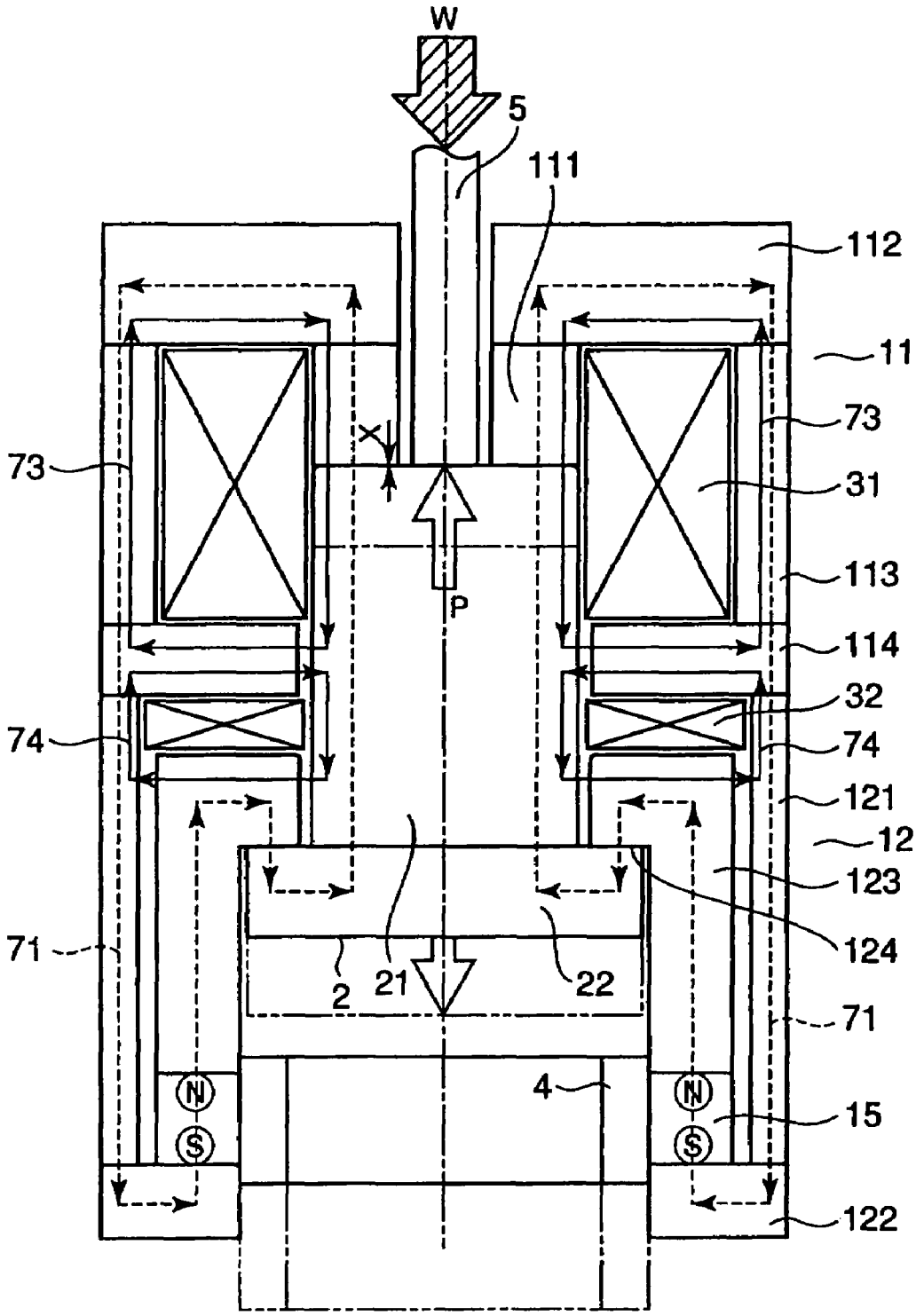
FIG. 11 is a diagram illustrating an operation through which the latched state is released by flowing an electric current through a first and a second coil in the second embodiment of the present invention.

In the state shown in FIG. 9, as shown in FIG. 11, when an electric current is flowed in either one or both of the first coil 31 and second coil 32 to cancel the magnetic flux of the permanent magnet 15, by the effect of magnetic flux shown by arrows 73 to be generated from the first coil 31 and/or by the effect of magnetic flux shown by arrows 74 to be generated from the second coil 32, the magnetic flux generated from the permanent magnet 15 and passing through the movable body 2, first stator 11 and second stator 12 is reduced, thus the load W will exceed the attracting force P exerted on the movable body 2, thereby releasing the movable body 2 from the latched state and lowering the movable body 2.

Figure 12:
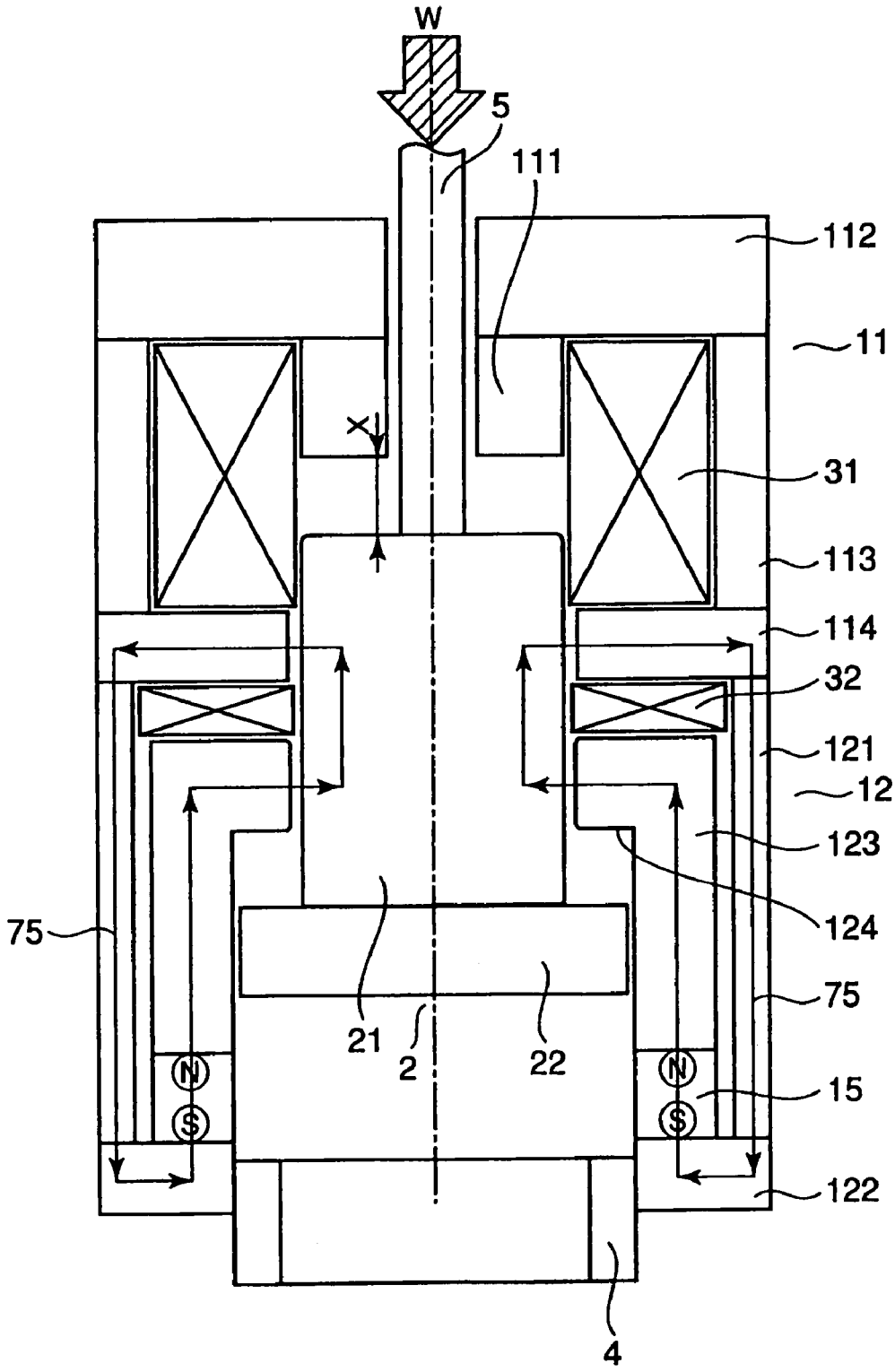
FIG. 12 is a diagram illustrating an electromagnetic actuator in a latch-released state in the second embodiment of the present invention.

As shown in FIG. 12, when the plunger 21, in the latched state, is moved away, by stroke X, from the pole piece 111, since the gap defined between the plunger 21 and the first hollow plate member 114 and the internal cylinder 123 is smaller than the gap between the plunger 21 and the pole piece 111 or the distance between the projecting plate member 22 of the movable body 2 and the receiving portion 124 of the internal cylinder 123, the magnetic flux from the permanent magnet 15 primarily forms a magnetic circuit pass as shown by arrows 75, thus the attracting force P is no longer exerted on the movable body 2.

Figure 13:
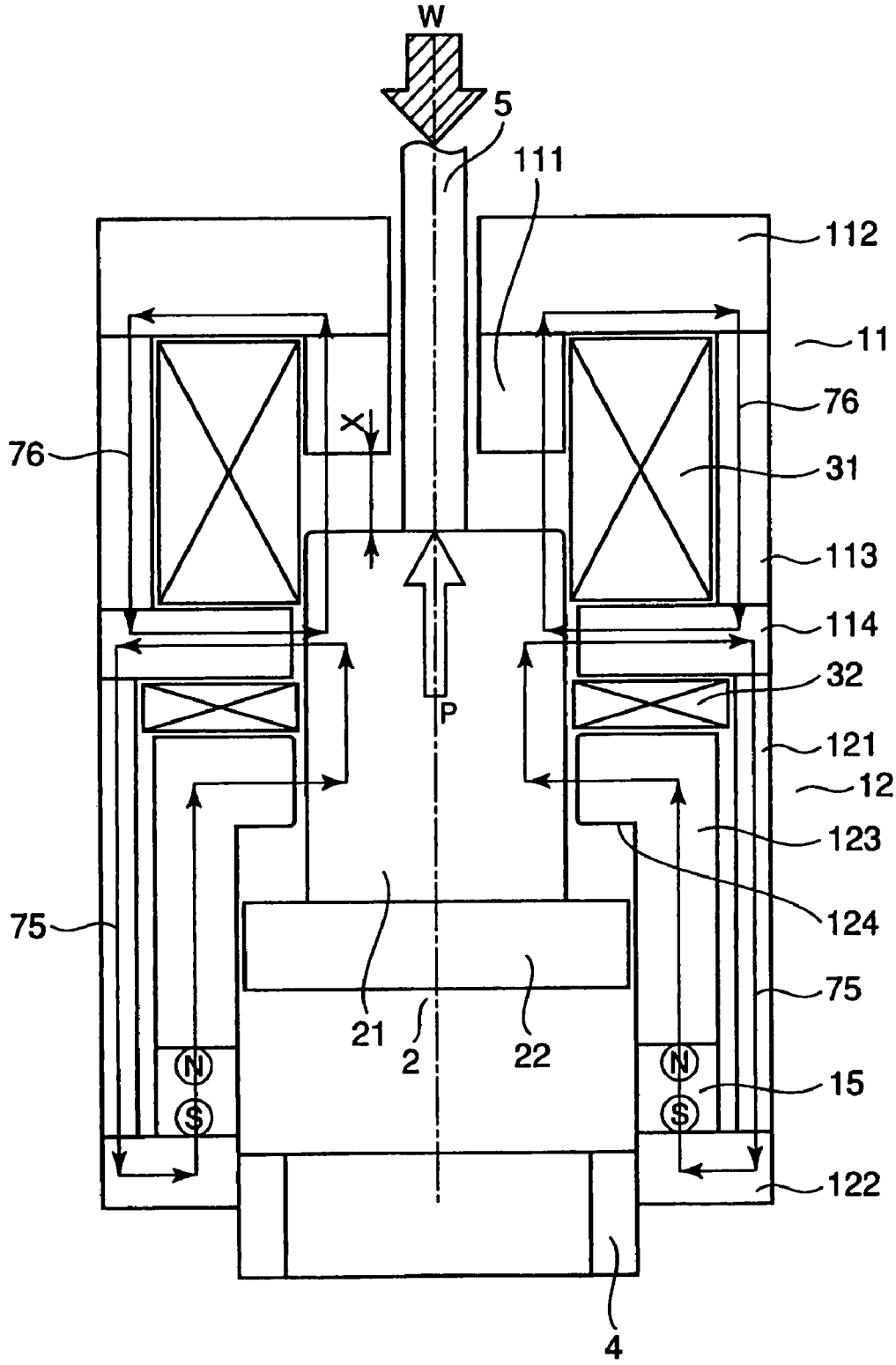
FIG. 13 is a diagram illustrating an operation through which a movable body in a latch-released state is attracted to a pole piece by flowing an electric current through the first coil in the second embodiment of the present invention.
Figure 14:
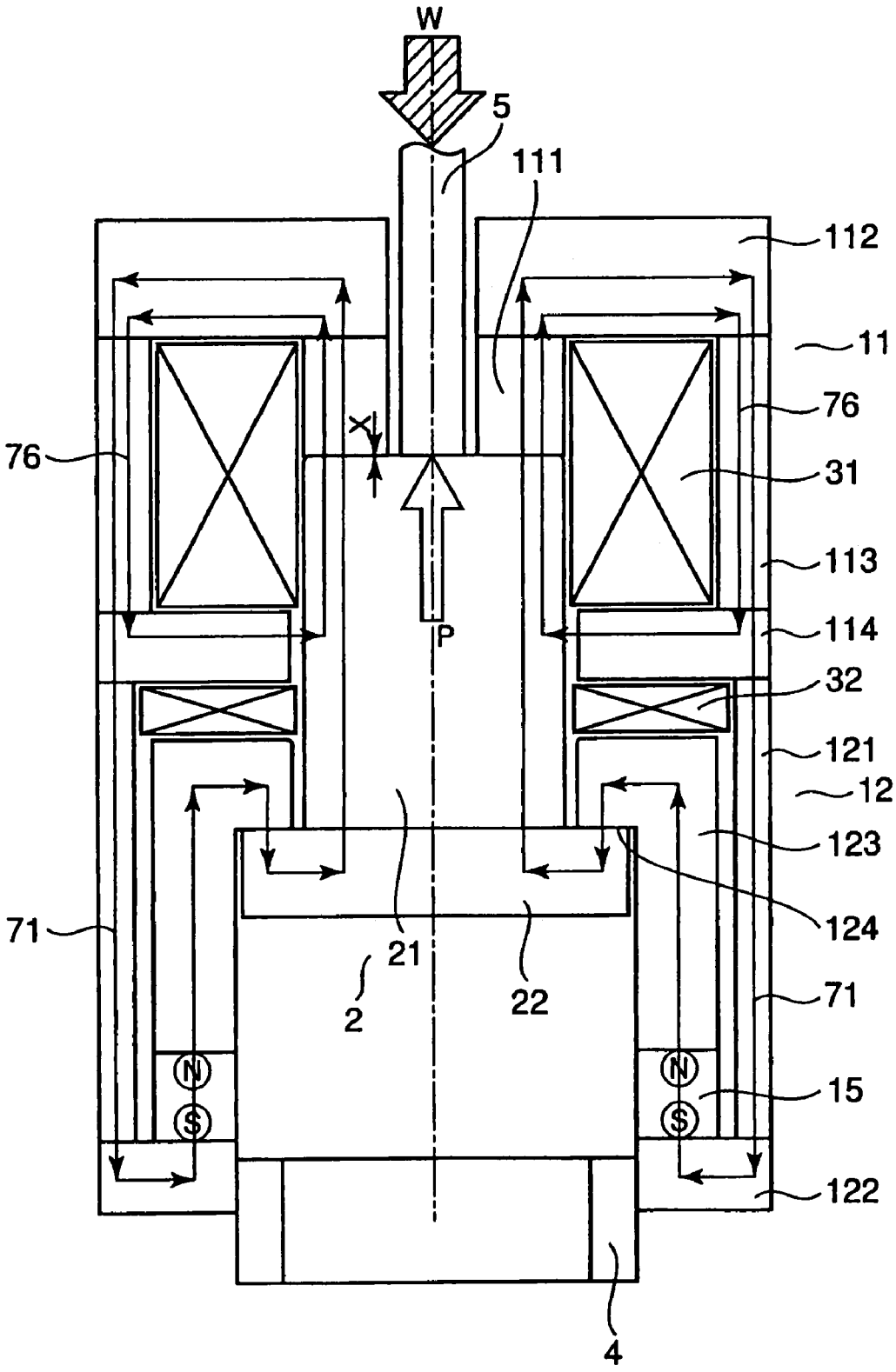
FIG. 14 is a diagram illustrating an operation through which a movable body in a latch-released state is attracted and latched by a pole piece by flowing an electric current through the first coil in the second embodiment of the present invention.
Figure 15:
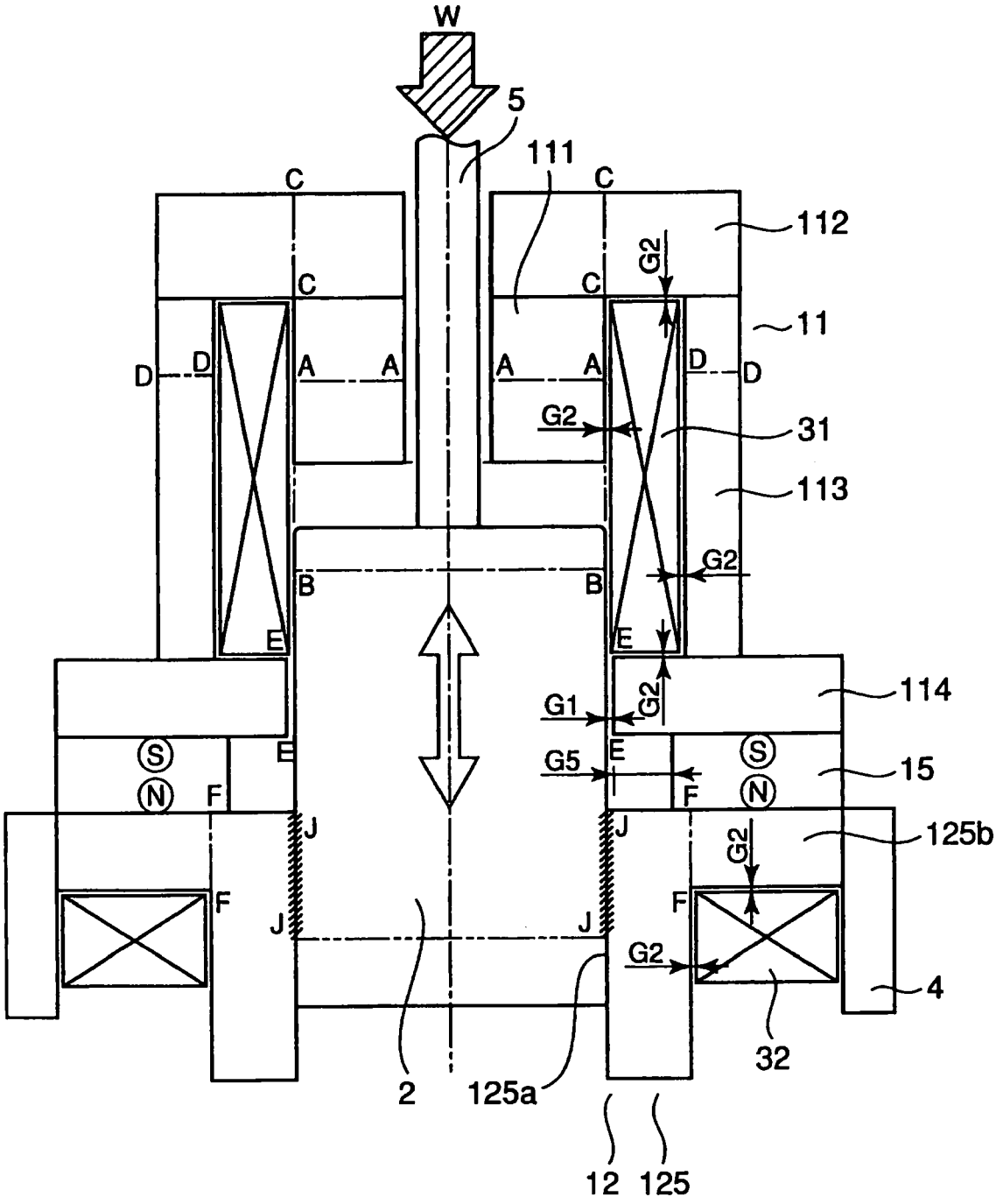
FIG. 15 is a cross section illustrating a third embodiment of an electromagnetic actuator according to the present invention.

As shown in FIG. 13, when magnetic flux is generated in the same direction as the magnetic flux from the permanent magnet 15 by making an electric current flow in the first coil 31, the resultant magnetic flux flows as shown by arrows 76, thus the movable body 2 is attracted toward the pole piece 111. As shown in FIG. 14, in a state where the movable body 2 is completely attracted to the pole piece 111, even if the electric current does no longer flow in the first coil 31, the movable body 2 remains attracted to the pole piece 111 by the effect of the magnetic flux generated from the permanent magnet 15 as shown in FIG. 9, as such maintaining the latched state.

As described above, according to this embodiment, the permanent magnet 15 is not inversely excited by the effect of magnetic flux to be generated from the first coil 31 and/or second coil 32 in either case. Additionally, since the permanent magnet 15, first coil 31 and second coil 32 are substantially surrounded by the first stator 11, second stator 12 and movable body 2 which are all formed from a ferromagnetic material or materials, the magnetic flux generated is not leaked away. In addition, since the movable body 2 is attracted to the two, i.e., S and N poles of the permanent magnet 15 upon latching the movable body 2, the latching force can be ensured by using less magnetic force.

Third Embodiment

Next, a third embodiment of the present invention will be described with reference to FIGS. 15 to 21. In FIGS. 15 to 21, like parts in the first embodiment shown in FIGS. 1 to 7 are respectively designated by the same reference numerals or characters, and detailed descriptions for those parts are omitted here.

In FIGS. 15 to 21, the permanent magnet 15 is attached to the hollow plate member 114 of the first stator 11. The second stator includes a cylindrical member 125 which has a flange 125*b* abutting the permanent magnet 15. The inner face 125*a* of the cylindrical member 125 is adjacent to the outer periphery of the movable body 2 with a slight gap provided therebetween. The second coil 32 is disposed in the cylindrical member 125 of the second stator 12. The short ring 4 is provided such that it can slide from a point around the flange 125*b* of the cylindrical member 125 to a point around the outer periphery of the permanent magnet 15.

As shown in FIGS. 15 to 21, in order to realize a highly efficient electromagnetic actuator, the pole piece 111 and the plunger 21 are configured to have the same outer diameter, and hence the cross section area taken along line A-A of the pole piece 111 is substantially the same as the cross section area taken along line B-B of the movable body 2.

The cylindrical cross section area taken along line C-C of the first plate member 112 and the cross section area taken along line D-D of the first cylinder 113 are substantially the same as or less than twice the cross section area taken along line B-B of the movable body 2. The cross section area of the inner hollow face E-E of the first hollow plate member 114 is substantially the same as the cross section area taken along line A-A of the pole piece 111. The cross section area taken along line F-F of the cylindrical member 125 is substantially the same as the cross section area of the permanent magnet 15. The inner face 125*a* of the cylindrical member 125 and the cross section area of the opposite face J-J of the movable body 2 are substantially the same as or greater than the cross section area taken along line B-B of the movable body 2 when the movable body 2 is in a position near to the pole piece 111.

The gap G1 defined between the inner face of the first hollow plate member 114 and the movable body 2 is properly set at 3 to 5 mm in order to efficiently centralize the magnetic flux generated from the permanent magnet 15, in a latched state, to an attracting face defined between the pole piece 111 and the movable body 2. The outer diameter of the first hollow plate member 114, outer diameter of the permanent magnet 15 and outer diameter of the flange 125*b* of the cylindrical member 125 are the same respectively, and the difference between the respective inner diameters of the permanent magnet 15 and the first hollow plate member 114 is set at 3 mm or greater.

The gap between the conductor of the first coil 31 and the electromagnetic components 112, 113, 114 surrounding this coil is set at 3 mm or less in order to efficiently utilize the magnetic flux generated from the first coil 31. The gap between the second coil 32 and the flange 125*b* is set at 3 mm or less both in the radial and axial directions in order to efficiently utilize the magnetic flux generated from the second coil 32.

Figure 16:
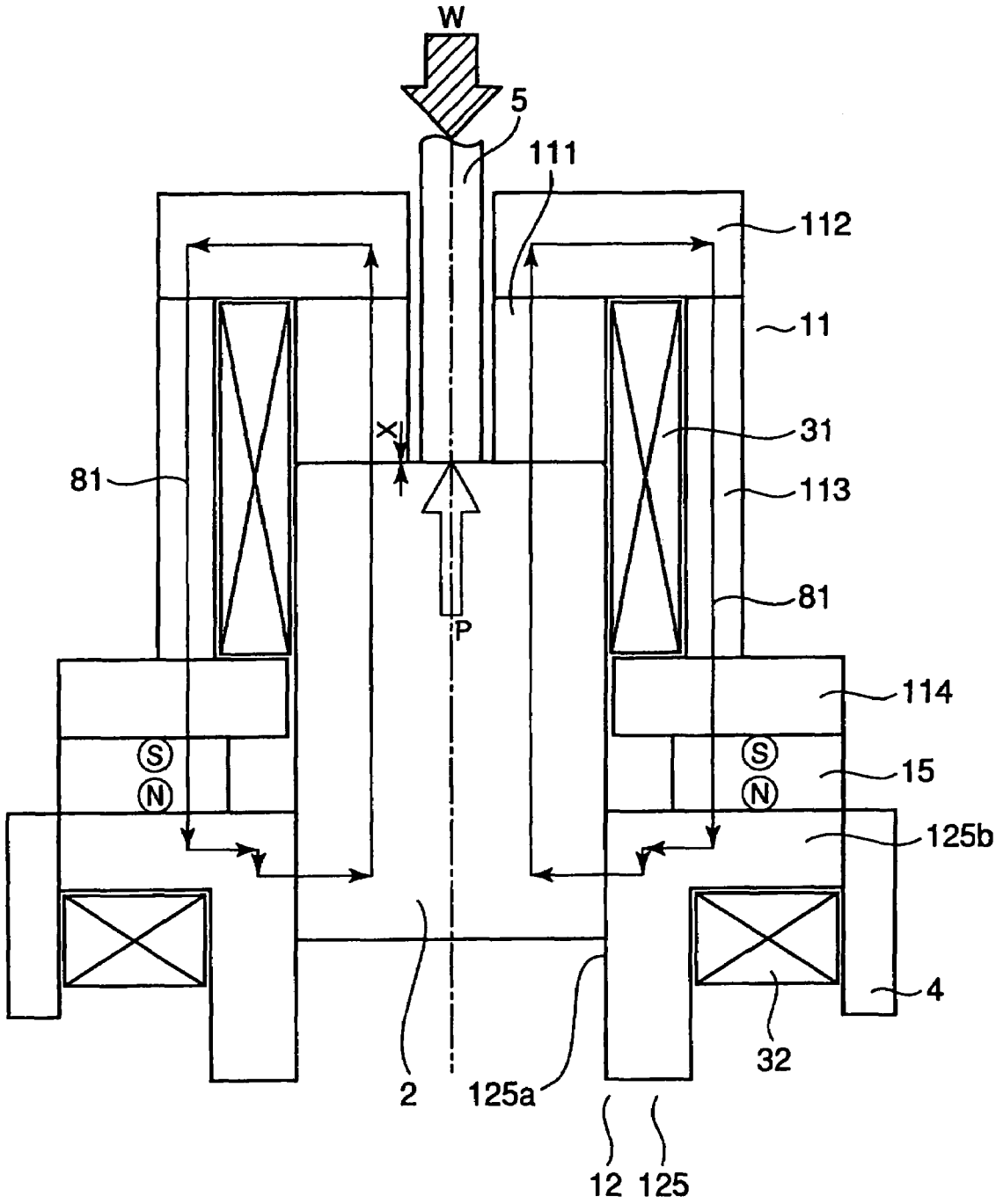
FIG. 16 is a diagram illustrating a movable body which is firmly latched by a permanent magnet in the third embodiment of the present invention.

Next, the operation of this embodiment as constructed above will be described. As shown in FIG. 16, when the gap X between the plunger 21 and the pole piece 111 is zero or quite small, the magnetic flux generated from the permanent magnet 15 forms a magnetic circuit pass defined through the first stator 11, the second stator 12 and the movable body 2, as shown by arrows 81. As a result, attracting force P is applied to the movable body 2 in the direction toward the pole piece 111, and thus the movable body 2 is in a latched state against the load W.

Figure 17:
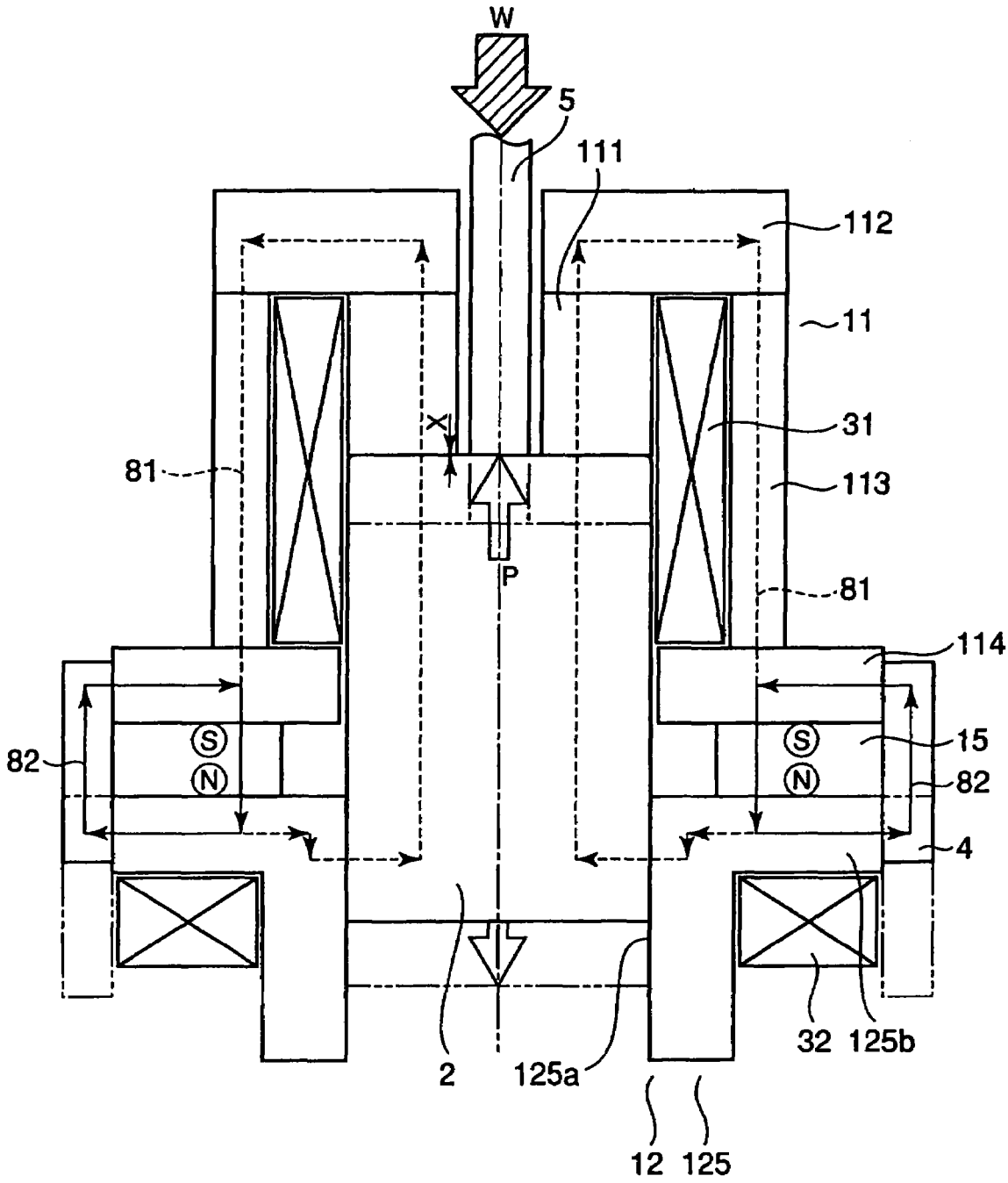
FIG. 17 is a diagram illustrating an operation through which the latched state is released by using a short ring in the third embodiment of the present invention.

In the state shown in FIG. 16, when the short ring 4 slides nearer to the permanent magnet 15, a part of the magnetic flux generated from the permanent magnet 15 is bypassed as shown by arrows 82 in FIG. 17, and as such the magnetic flux between the pole piece 111 and the movable body 2 is reduced, thus the load W will exceed the attracting force P, thereby releasing the movable body 2 from the latched state and lowering the movable body 2.

Figure 18:
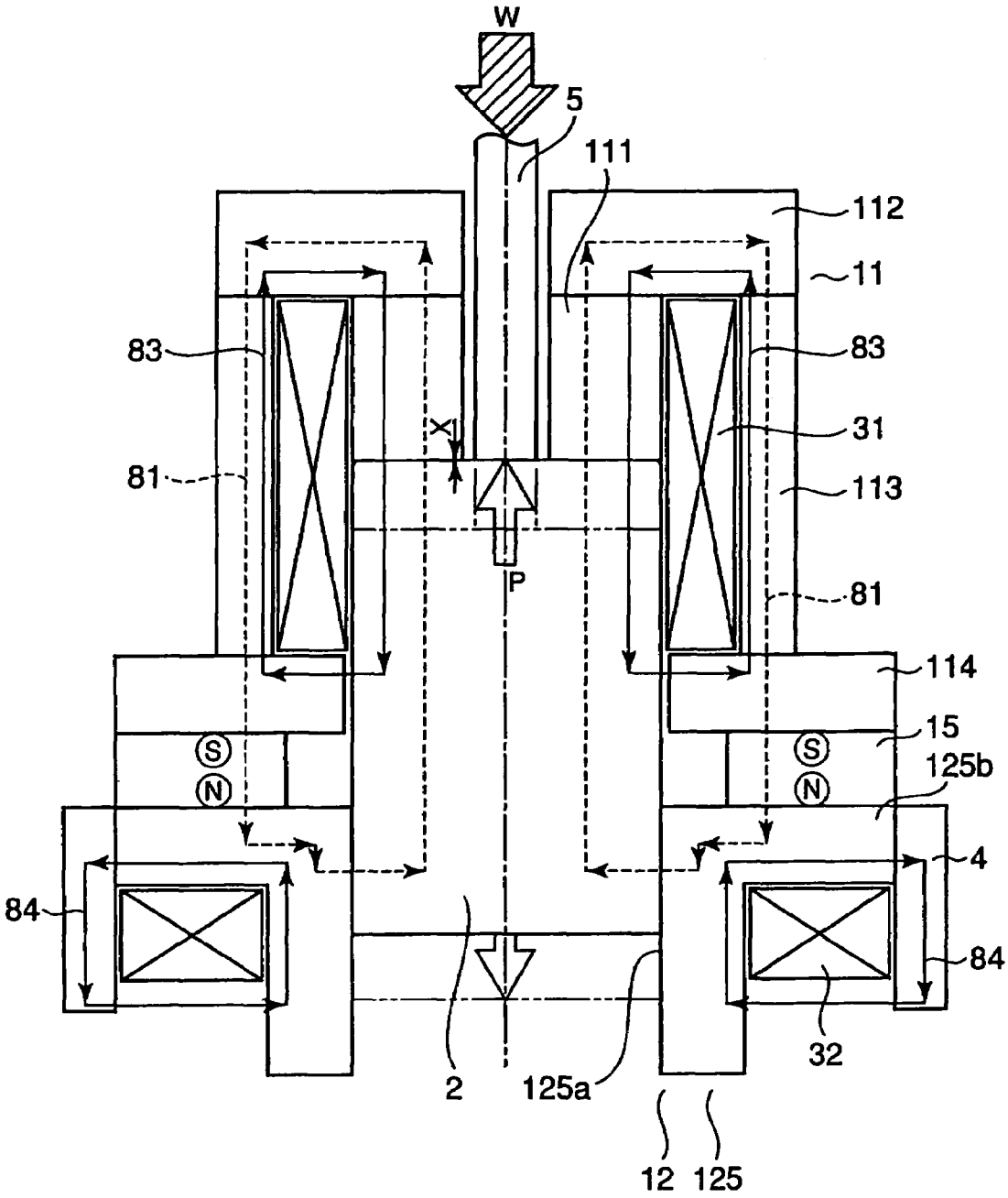
FIG. 18 is a diagram illustrating an operation through which the latched state is released by flowing an electric current through a first and a second coil in the third embodiment of the present invention.

In the state shown in FIG. 16, as shown in FIG. 18, when an electric current is flowed in either one or both of the first coil 31 and second coil 32 to cancel the magnetic flux of the permanent magnet 15, by the effect of magnetic flux shown by arrows 83 to be generated from the first coil 31 and/or by the effect of magnetic flux shown by arrows 84 to be generated from the second coil 32, the magnetic flux generated from the permanent magnet 15 and passing through the movable body 2, first stator 11 and second stator 12 is reduced, thus the load W will exceed the attracting force P exerted on the movable body 2, thereby releasing the movable body 2 from the latched state and lowering the movable body 2.

Figure 19:
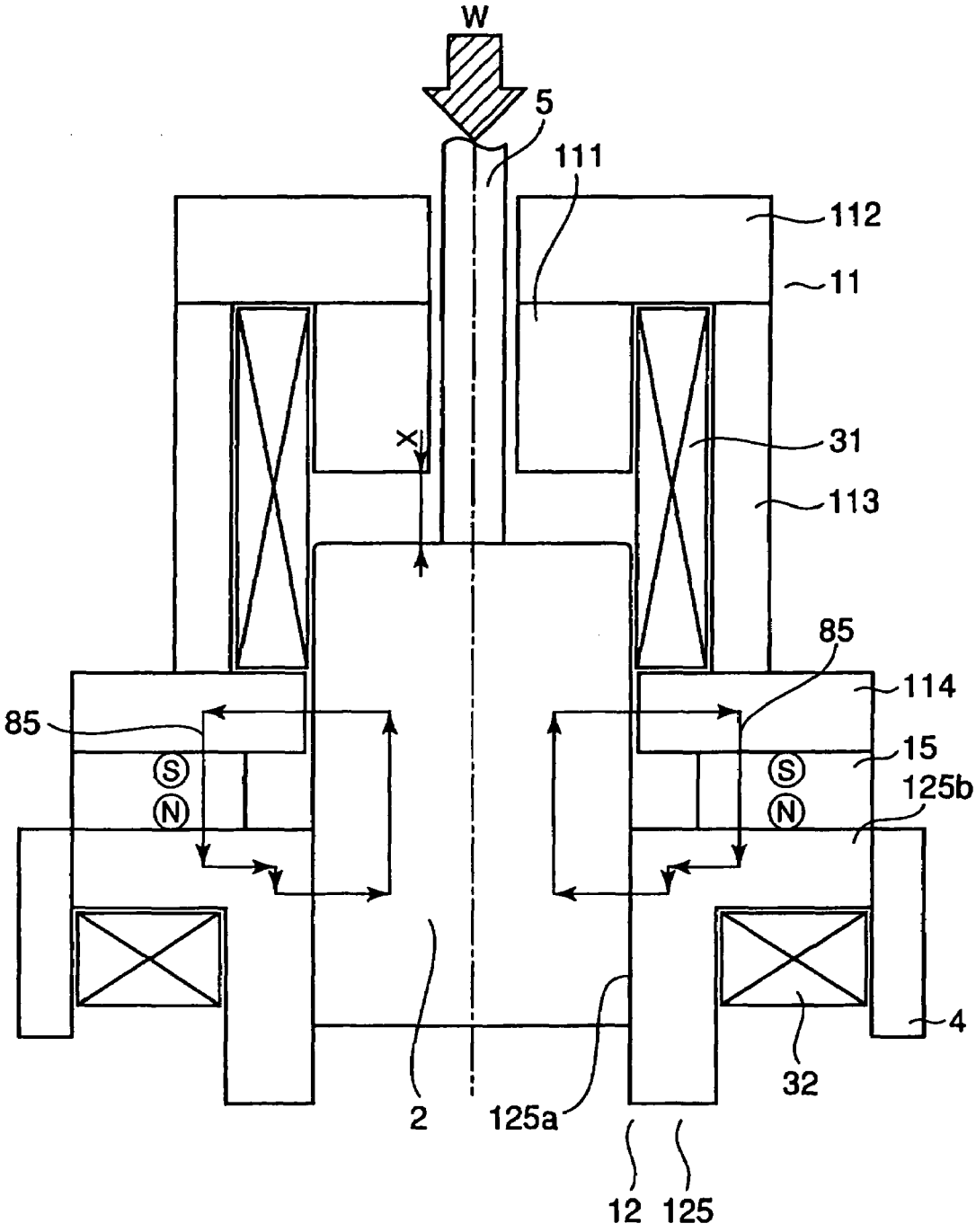
FIG. 19 is a diagram illustrating an electromagnetic actuator in a latch-released state in the third embodiment of the present invention.

As shown in FIG. 19, when the movable body 2, in the latched state, is moved away, by stroke X, from the pole piece 111, since the gap defined between the movable body 2 and the first hollow plate member 114 is smaller than the distance between the movable body 2 and the pole piece 111, the magnetic flux from the permanent magnet 15 forms a magnetic circuit pass as shown by arrows 85, thus the attracting force P is no longer exerted on the movable body 2.

Figure 20:
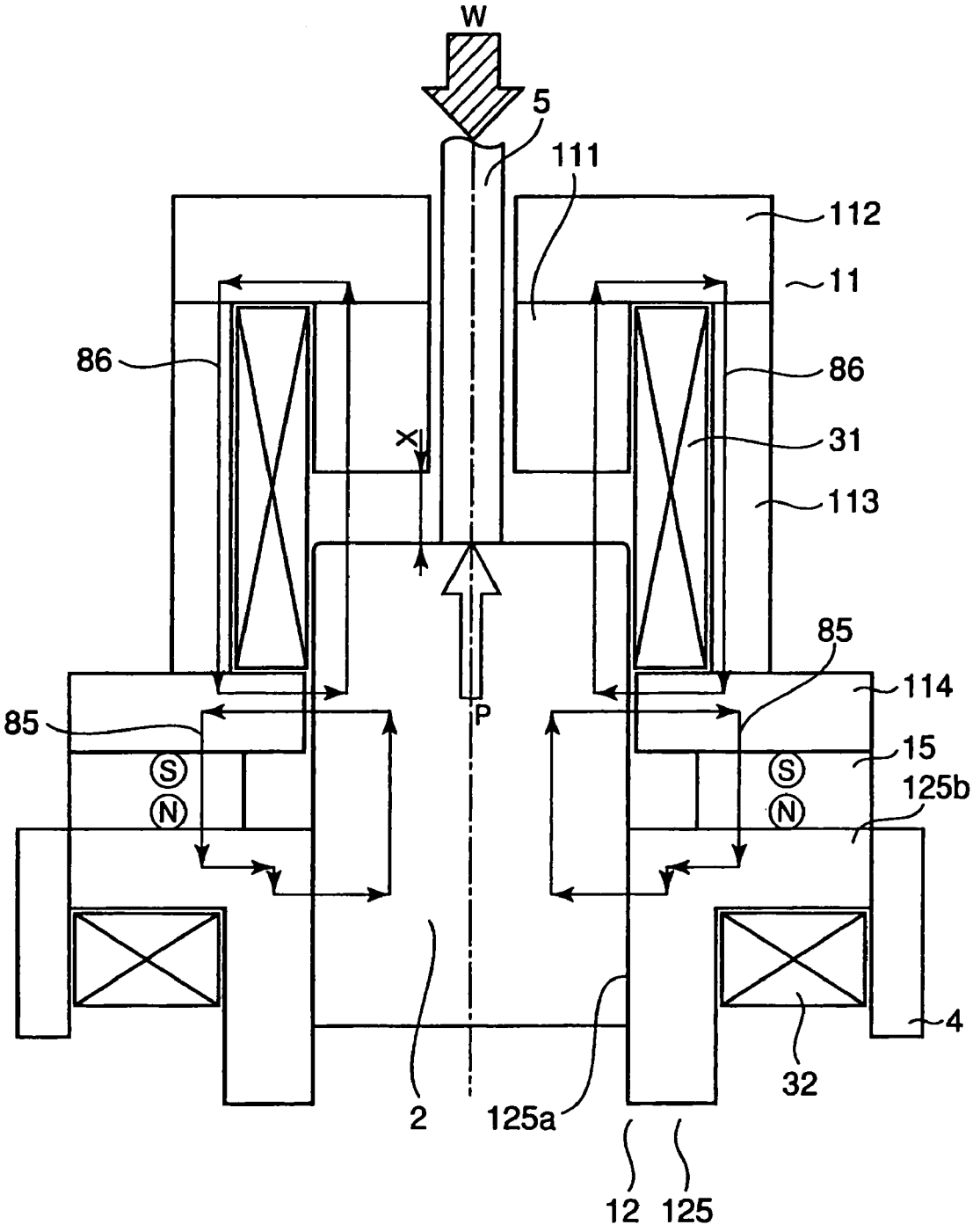
FIG. 20 is a diagram illustrating an operation through which a movable body in a latch-released state is attracted to a pole piece by flowing an electric current through the first coil in the third embodiment of the present invention.
Figure 21:
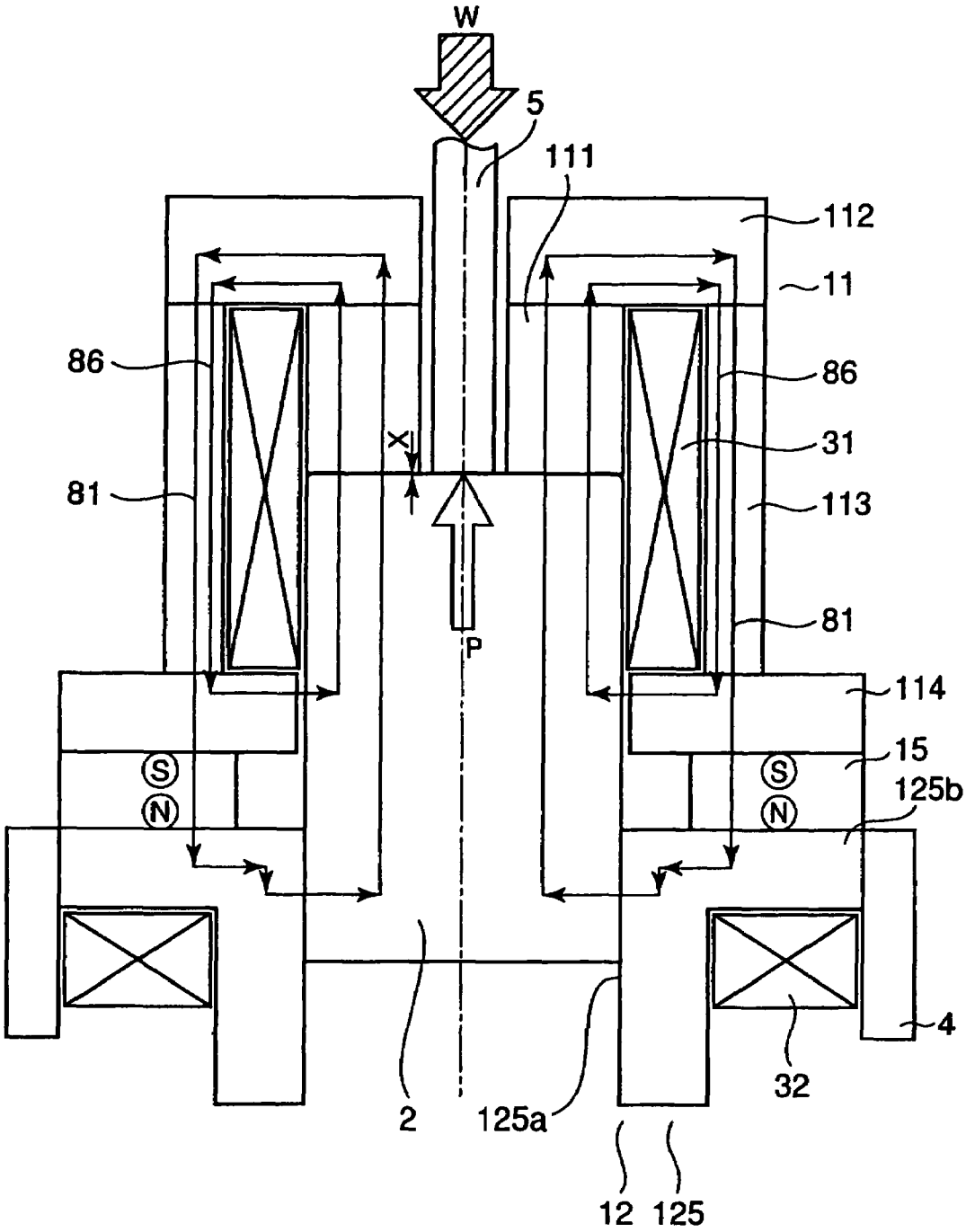
FIG. 21 is a diagram illustrating an operation through which a movable body in a latch-released state is attracted and latched by a pole piece by flowing an electric current through the first coil in the third embodiment of the present invention.
Figure 22:
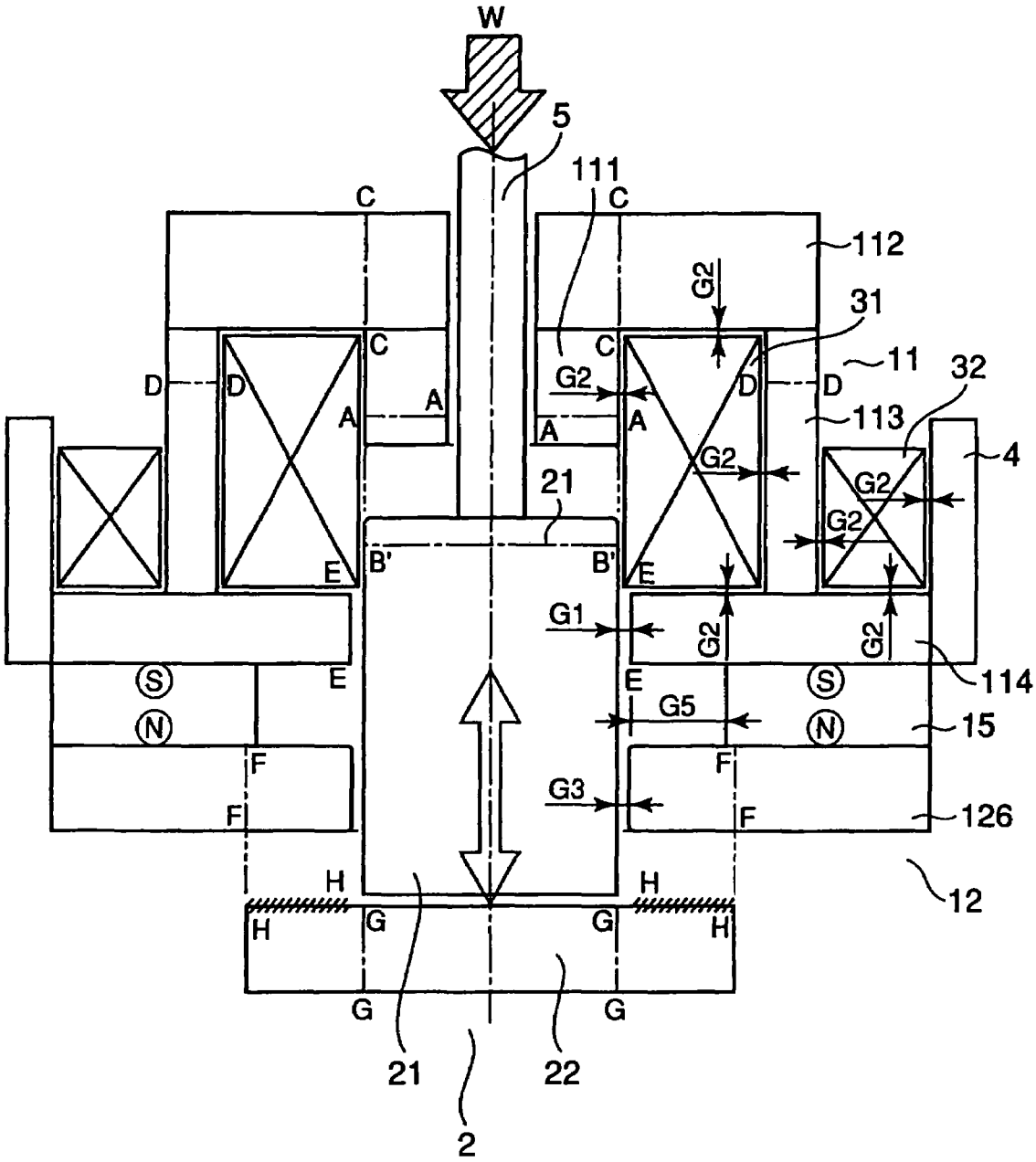
FIG. 22 is a cross section illustrating a fourth embodiment of an electromagnetic actuator according to the present invention.

As shown in FIG. 20, when magnetic flux is generated in the same direction as the magnetic flux from the permanent magnet 15 by flowing an electric current in the first coil 31, the resultant magnetic flux flows as shown by arrows 86, thus the movable body 2 is attracted toward the pole piece 111. As shown in FIG. 21, in a state where the movable body 2 is completely attracted to the pole piece 111, even if the electric current does no longer flow in the first coil 31, the movable body 2 remains attracted to the pole piece 111 by the effect of the magnetic flux generated from the permanent magnet 15 as shown in FIG. 16, as such maintaining the latched state.

As described above, according to this embodiment, the permanent magnet 15 is not inversely excited by the effect of magnetic flux to be generated from the first coil 31 and/or second coil 32 in either case. By providing the permanent magnet 15 at an outermost periphery of the electromagnetic actuator, a magnet which provides a less magnetic flux density and is lower in price can be utilized. Thus, a lower-priced electromagnetic actuator can be provided in place of recent high-performance magnets.

Fourth Embodiment

Next, a fourth embodiment of the present invention will be described with reference to FIGS. 22 to 28. In FIGS. 22 to 28, like parts in the first embodiment shown in FIGS. 1 to 7 are respectively designated by the same reference numerals or characters, and detailed descriptions for those parts are omitted here.

In FIGS. 22 to 28, the movable body 2 has the same construction as that of the second embodiment. Namely, the movable body 2 includes a plunger 21 which is formed from a magnetic material and moves on the central axis of the first coil 31, and a ferromagnetic plate member (projecting plate member) 22 which is provided on the opposite side of the nonmagnetic shaft 5 connected with the load W and projects radially outward from the plunger 21. The second stator 12 is composed only of a hollow plate member (third hollow plate member) 126. The permanent magnet 15 is interposed between the first hollow plate member 114 of the first stator 11 and the third hollow plate member 126 of the second stator 12. The third hollow plate member 126 is adapted to regulate the magnetic flux generated from the magnetic pole appearing on the bottom side of the permanent magnet 15 as well as to flow the regulated magnetic flux into the projecting plate member 22 of the movable body 2. The second coil 32 is disposed outside the first stator 11, and the short ring 4 is provided such that it can slide from a point around the third hollow plate member 126 to a point around the outer periphery of the permanent magnet 15.

In FIGS. 22 to 28, assuming that the south (S) pole of the permanent magnet 15 is arranged to face upward while the north (N) pole arranged to face downward for example, the S pole appears at the pole piece 111 while the N pole appears on the bottom side of the hollow plate member 126, thus the movable body 2 is attracted in the latched state by both the N and S poles.

As shown in FIGS. 22 to 28, in order to realize a highly efficient electromagnetic actuator, the pole piece 111 and the plunger 21 are designed to have the same outer diameter, and hence the cross section area taken along line A-A of the pole piece 111 is substantially the same as the cross section area taken along line B'-B' of the plunger 21. The cylindrical cross section area taken along line C-C of the first plate member 112 and the cross section area taken along line D-D of the first cylinder 113 are substantially the same as or less than twice the cross section area taken along line B'-B' of the plunger 21. The cross section area of the inner hollow face E-E of the first hollow plate member 114 is substantially the same as the cross section area taken along line A-A of the pole piece 111. The cylindrical cross section area taken along line F-F of the third cylinder 126, the cylindrical cross section area taken along line G-G of the second projecting plate member 22 of the movable body 2, the area H-H over which the projecting plate member 22 will contact with the third hollow plate member 126 are substantially the same as the cross section area of the permanent magnet 15. The gap G1 defined between the inner hollow face of the first hollow plate member 114 and the plunger 21 is set at 3 to 5 mm and the gap G3 defined between the inner hollow face of the third hollow plate member 126 and the plunger 21 is set at 1 to 5 mm, respectively, in order to efficiently centralize the magnetic flux generated from the permanent magnet 15, in a latched state, to an attracting face defined between the pole piece 111 and the plunger 21 as well as to a contacting face defined between the projecting plate member 22 of the movable body 2 and the third hollow plate member 126. In addition, the outer diameter of the first hollow plate member 114, the outer diameter of the permanent magnet 15 and the outer diameter of the flange of cylinder 125 are the same. In this case, the inner diameter of the permanent magnet 15 is greater by 3 mm than the inner diameter of the first hollow plate member 114.

A gap defined between the conductor of the first coil 31 or conductor of the second coil 32 and the electromagnetic components 112, 113, 114 or 126 surrounding the coils is set at 3 mm or less in order to efficiently utilize the magnetic flux generated from the respective coils 31, 32.

Next, the operation of this embodiment constructed as described above will be explained.

Figure 23:
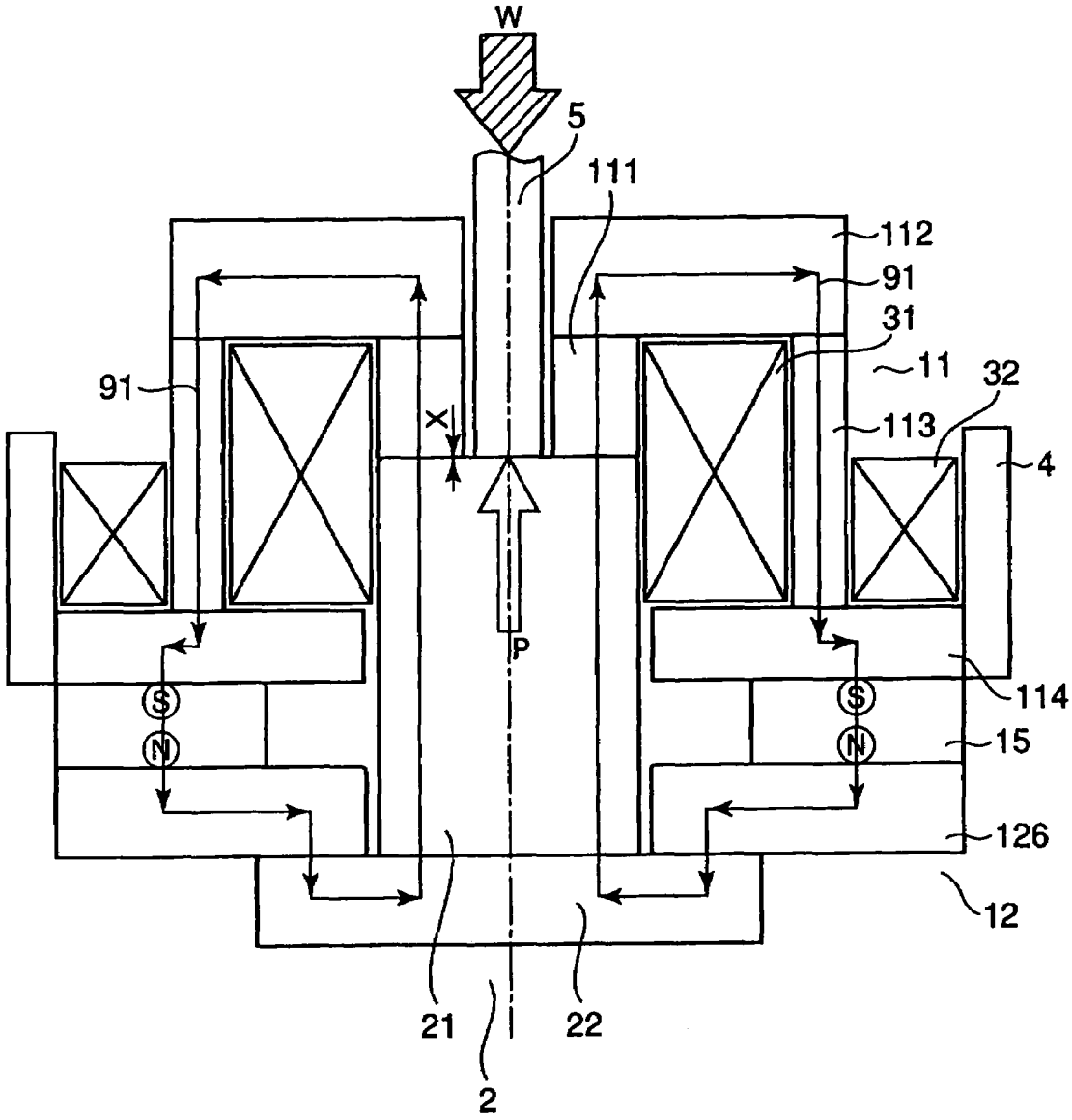
FIG. 23 is a diagram illustrating a movable body which is firmly latched by a permanent magnet in the fourth embodiment of the present invention.

As shown in FIG. 23, when a gap X between the plunger 21 and the pole piece 111 is zero or quite small, the magnetic flux generated from the permanent magnet 15 forms a magnetic circuit pass defined through the first stator 11, the second stator 12 and the movable body 2, as shown by arrows 91. In this way, attracting force P is applied to the movable body 2 in the direction toward the pole piece 111, and thus the movable body 2 is in a latched state against the load W.

Figure 24:
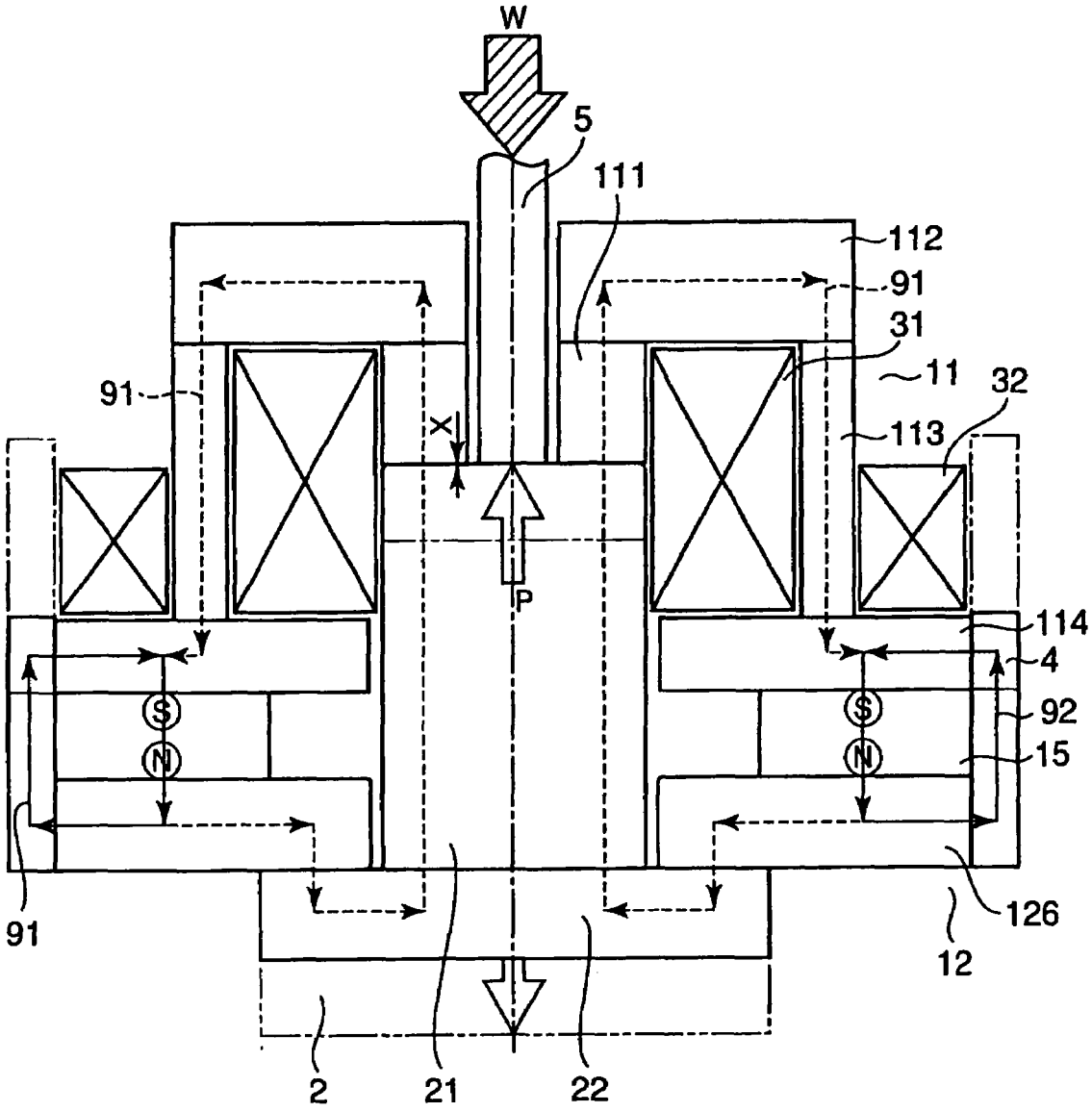
FIG. 24 is a diagram illustrating an operation through which the latched state is released by using a short ring in the fourth embodiment of the present invention.

In the state shown in FIG. 23, when the short ring 4 slides nearer to the permanent magnet 15, a part of the magnetic flux generated from the permanent magnet 15 is bypassed as shown by arrows 92 in FIG. 24, and as such the magnetic flux between the pole piece 111 and the movable body 2 is reduced, thus the load W will exceed the attracting force P, thereby releasing the movable body 2 from the latched state and lowering the movable body 2.

Figure 25:
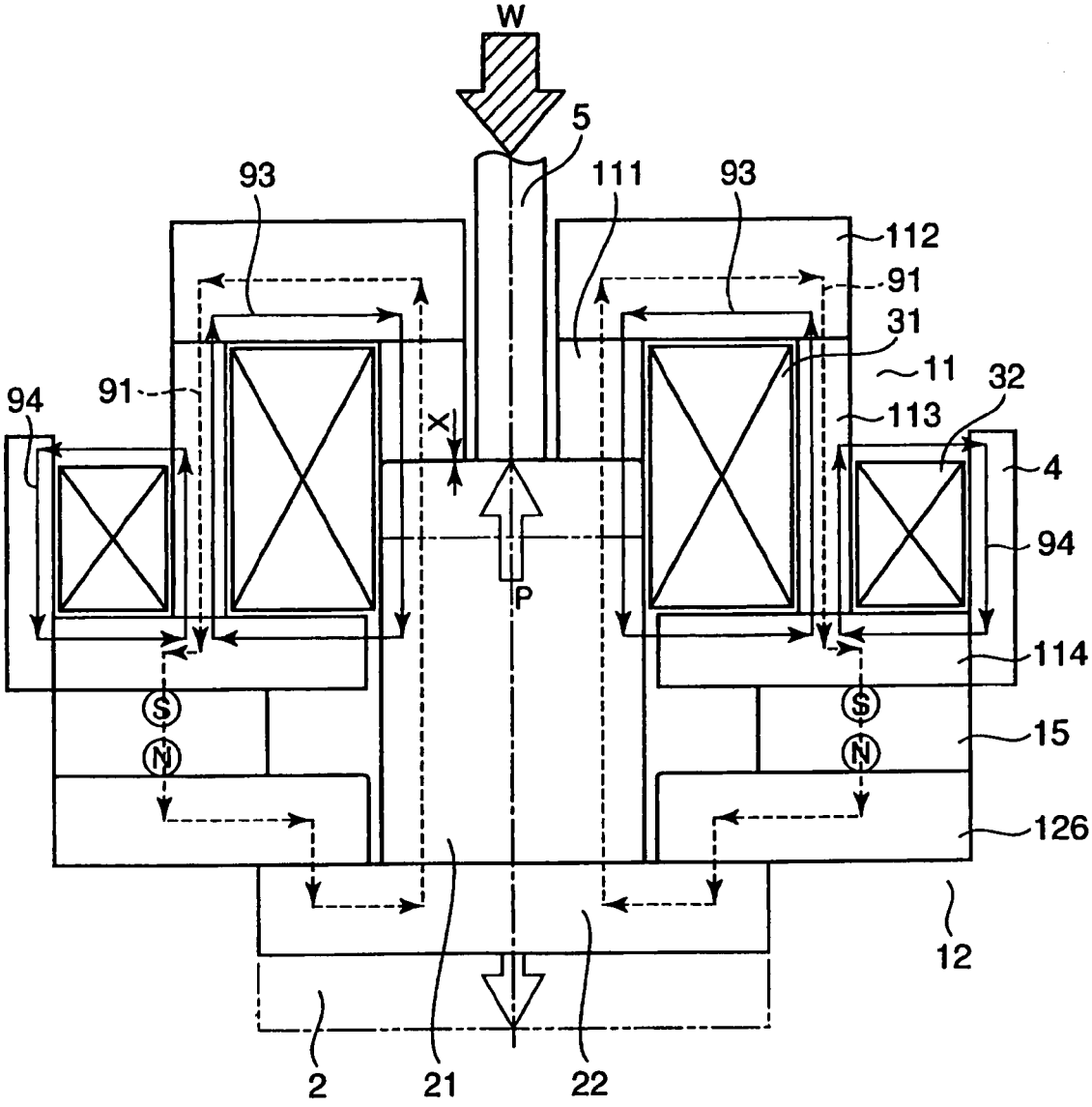
FIG. 25 is a diagram illustrating an operation through which the latched state is released by flowing an electric current through a first and a second coil in the fourth embodiment of the present invention.

In the state shown in FIG. 23, as shown in FIG. 25, when an electric current flows in either one or both of the first coil 31 and second coil 32 to cancel the magnetic flux of the permanent magnet 15, by the effect of magnetic flux shown by arrows 93 to be generated from the first coil 31 and/or by the effect of magnetic flux shown by arrows 94 to be generated from the second coil 32, the magnetic flux generated from the permanent magnet 15 and passing through the movable body 2, first stator 11 and second stator 12 is reduced, thus the load W will exceed the attracting force P exerted on the movable body 2, thereby releasing the movable body 2 from the latched state and lowering the movable body 2.

Figure 26:
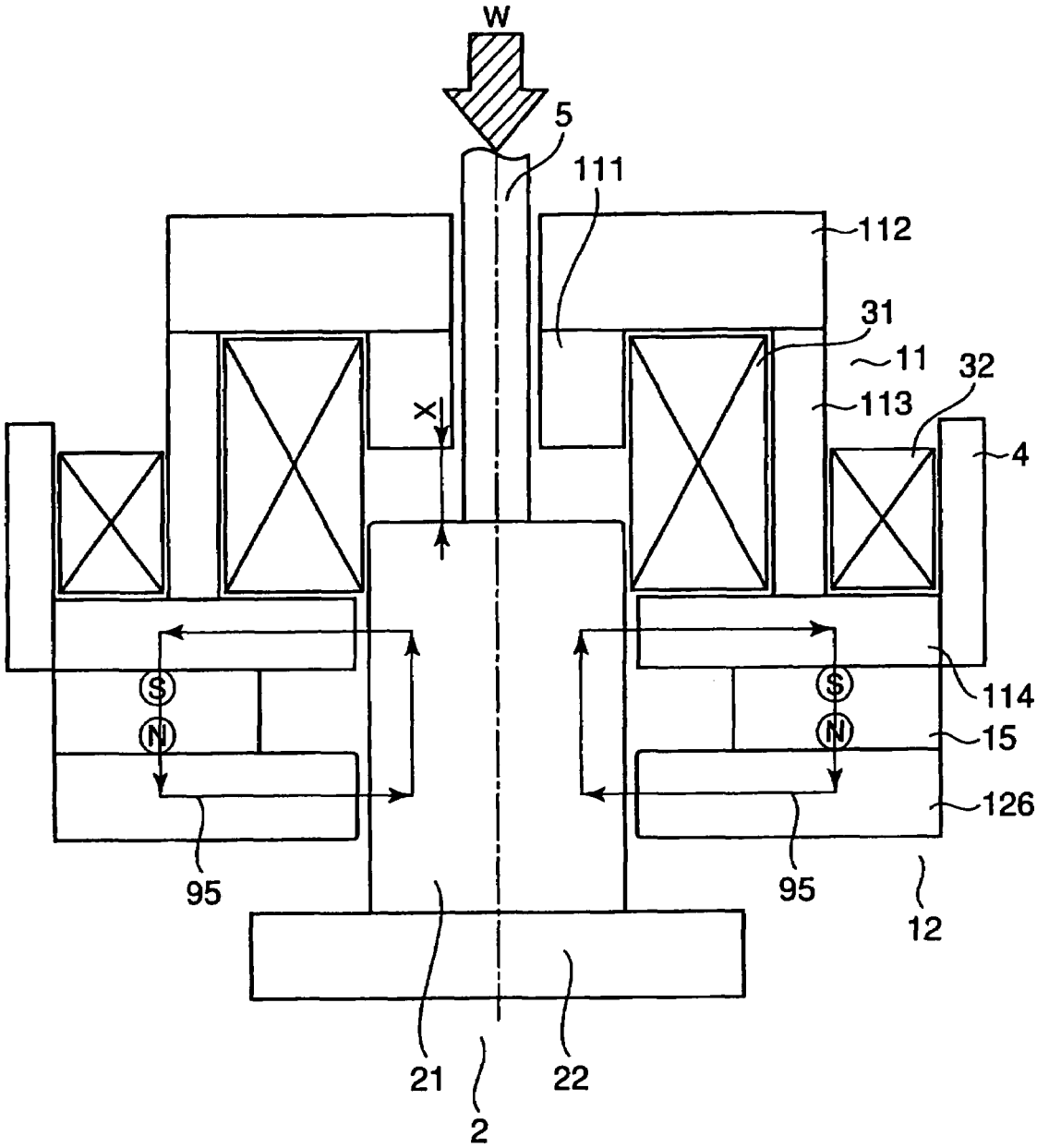
FIG. 26 is a diagram illustrating an electromagnetic actuator in a latch-released state in the fourth embodiment of the present invention.
Figure 27:
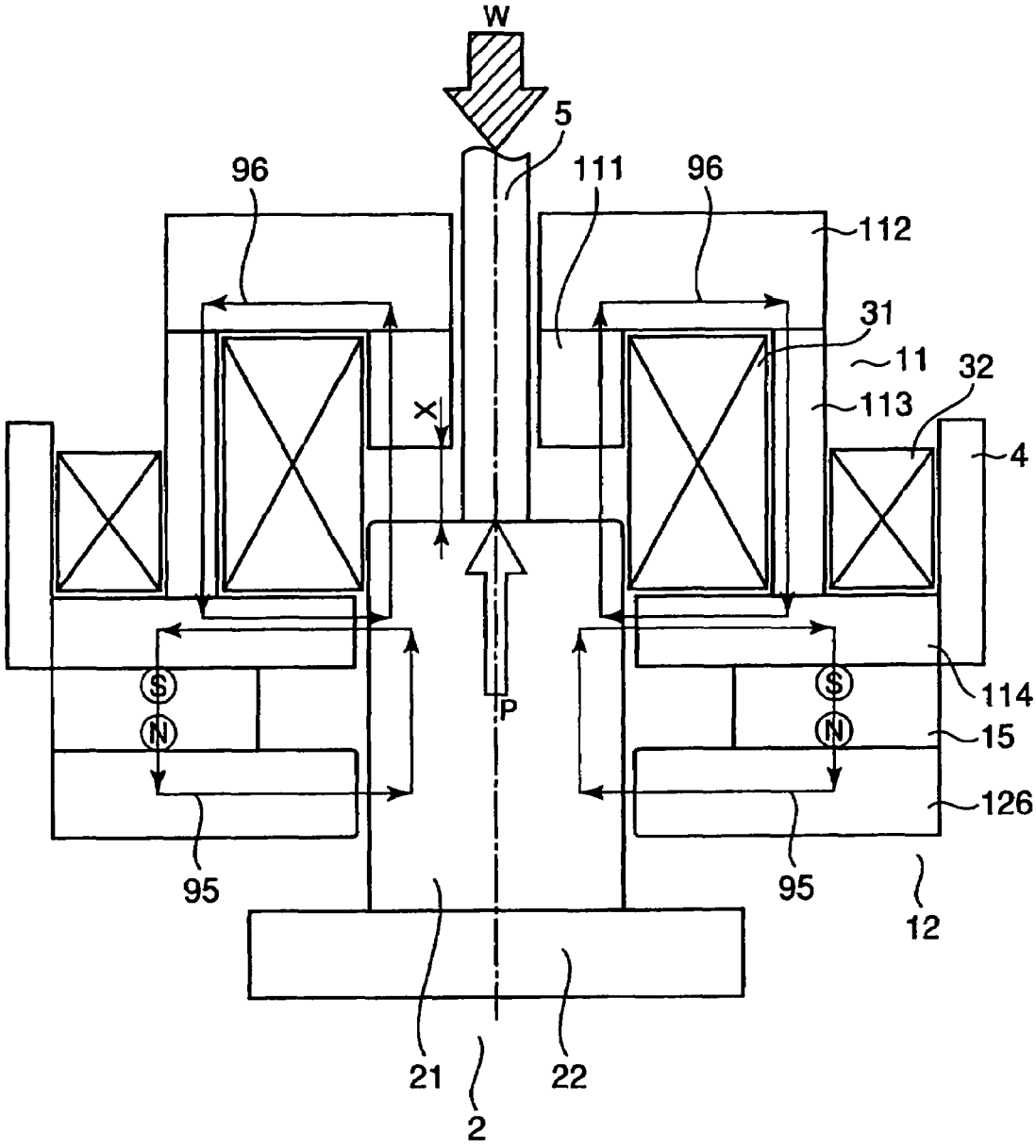
FIG. 27 is a diagram illustrating an operation through which a movable body in a latch-released state is attracted to a pole piece by flowing an electric current through the first coil in the fourth embodiment of the present invention.
Figure 28:
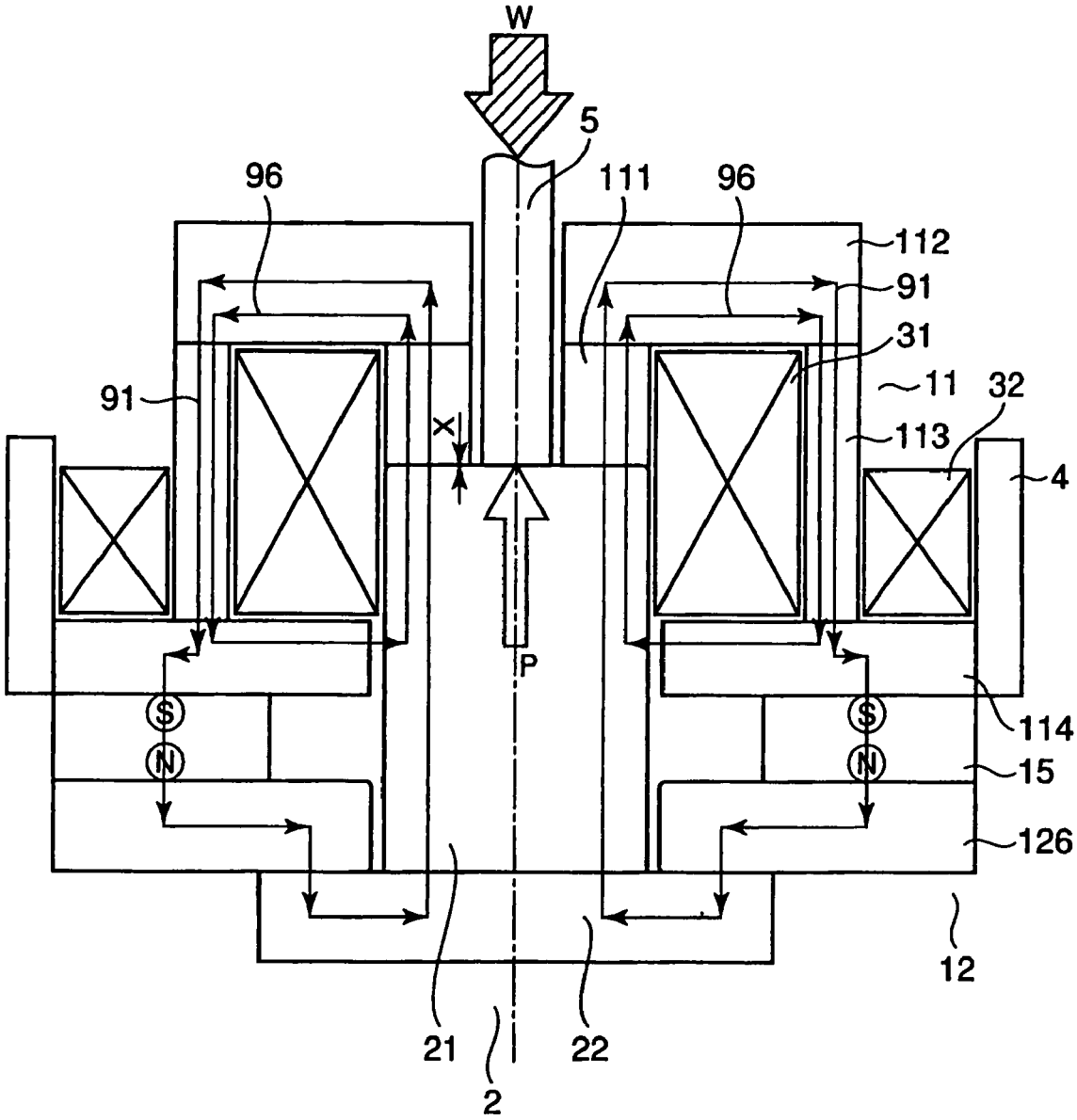
FIG. 28 is a diagram illustrating an operation through which a movable body in a latch-released state is attracted and latched by a pole piece by flowing an electric current through the first coil in the fourth embodiment of the present invention.

As shown in FIG. 26, when the movable body 2, in the latched state, is moved away, by stroke X, from the pole piece 111, since the gap defined between the plunger 21 and the first hollow plate member 114 or third hollow plate member 126 is smaller than the gap between the plunger 21 and the pole piece 111 or the distance between the projecting plate member 22 of the movable body 2 and the third hollow plate member 126, the magnetic flux from the permanent magnet 15 forms a magnetic circuit pass as shown by arrows 95, thus the attracting force P is no longer exerted on the movable body 2. As shown in FIG. 27, when magnetic flux is generated in the same direction as the magnetic flux from the permanent magnet 15 by making an electric current flow in the first coil 31, the resultant magnetic flux flows as shown by arrows 96, thus the movable body 2 is attracted toward the pole piece 111. As shown in FIG. 28, even if the electric current does no longer flow in the first coil 31 in a state where the movable body 2 is completely attracted to the pole piece 111, the movable body 2 remains attracted to the pole piece 111 by the effect of the magnetic flux generated from the permanent magnet 15 as shown in FIG. 23, as such maintaining the latched state.

As described above, according to this embodiment, the permanent magnet 15 is not inversely excited by the effect of magnetic flux to be generated from the first coil 31 and/or second coil 32 in either case. By providing the permanent magnet 15 at an outermost periphery of the electromagnetic actuator, a magnet which provides a less magnetic flux density and is lower in price can be utilized. Thus, a lower-priced electromagnetic actuator can be provided in place of recently-known high-performance magnets. In addition, since the movable body 2 is attracted to the two, i.e., S and N poles of the permanent magnet 15 upon latching the movable body 2, the latching force can be ensured by using less magnetic force.

Fifth Embodiment

Next, a fifth embodiment of the present invention will be described with reference to FIG. 29. In the fifth embodiment, except that the arrangement of the coils is changed, the other configuration is the same as the previously described first to fourth embodiments.

In the fifth embodiments, the second coil 32 is omitted, and this electromagnetic actuator can be operated by switching the direction of the electric current flowed in the first coil 31.

Figure 29:
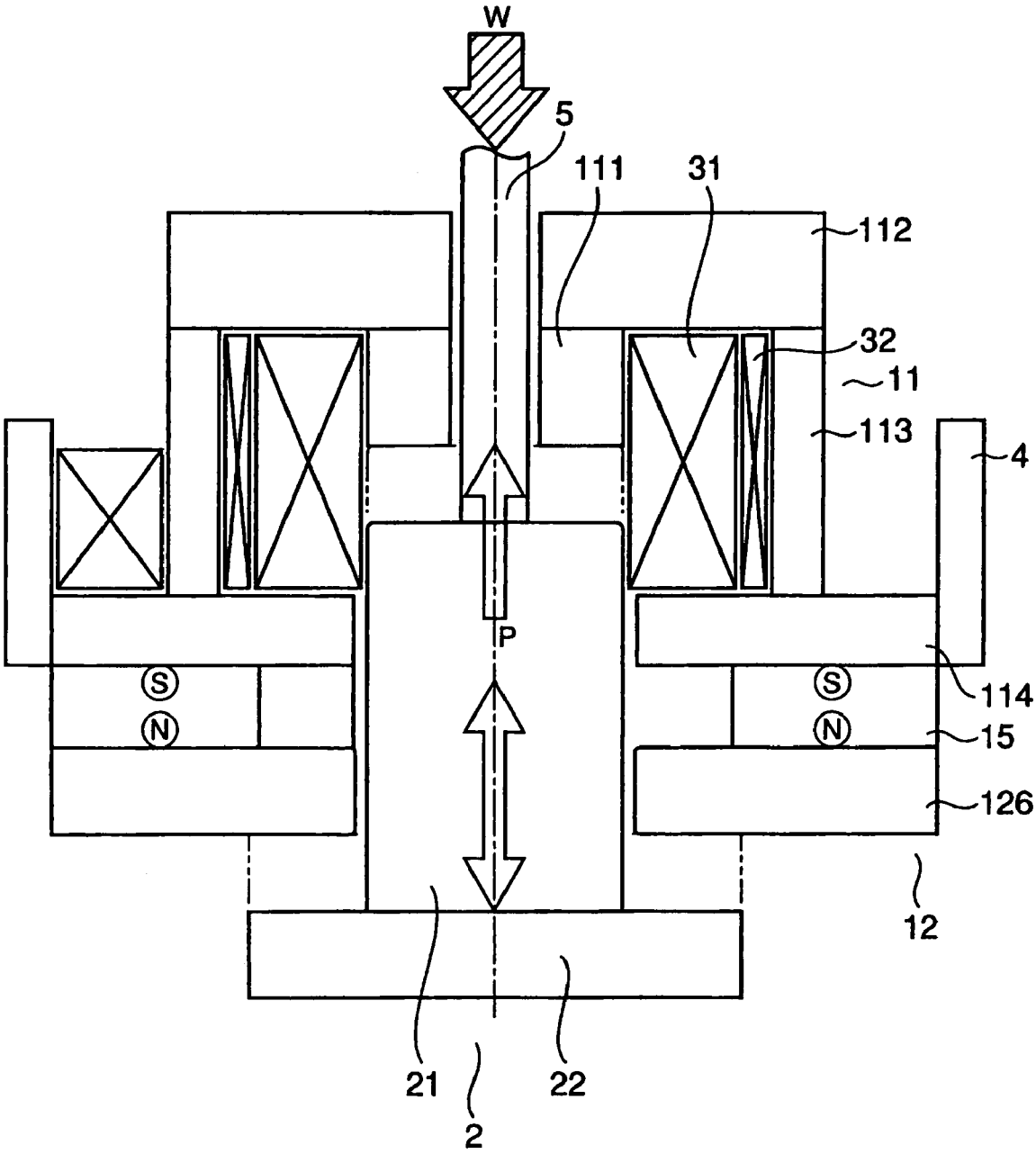
FIG. 29 is a cross section illustrating a fifth embodiment of an electromagnetic actuator according to the present invention.

As shown in FIG. 29, the second coil 32 may be provided at the outer periphery of the first coil 31. In FIG. 29, when the movable body 2 is attracted toward the pole piece 111, an electric current flows only in the first coil 31 or may be flowed both in the first and second coils 31, 32. Meanwhile, when the latched state of the movable body 2 caused by the permanent magnet 15 is released, an electric current flows either one or both of the first and second coils 31, 32 to operate the electromagnetic actuator as needed.

Sixth Embodiment

Next, a sixth embodiment of the present invention will be described with reference to FIGS. 30 to 33. In the sixth embodiment shown in FIGS. 30 to 33, like parts in the first embodiment shown in FIGS. 1 to 7 are respectively designated by the same reference numerals or characters, and detailed descriptions for those parts are omitted here.

Figure 30:
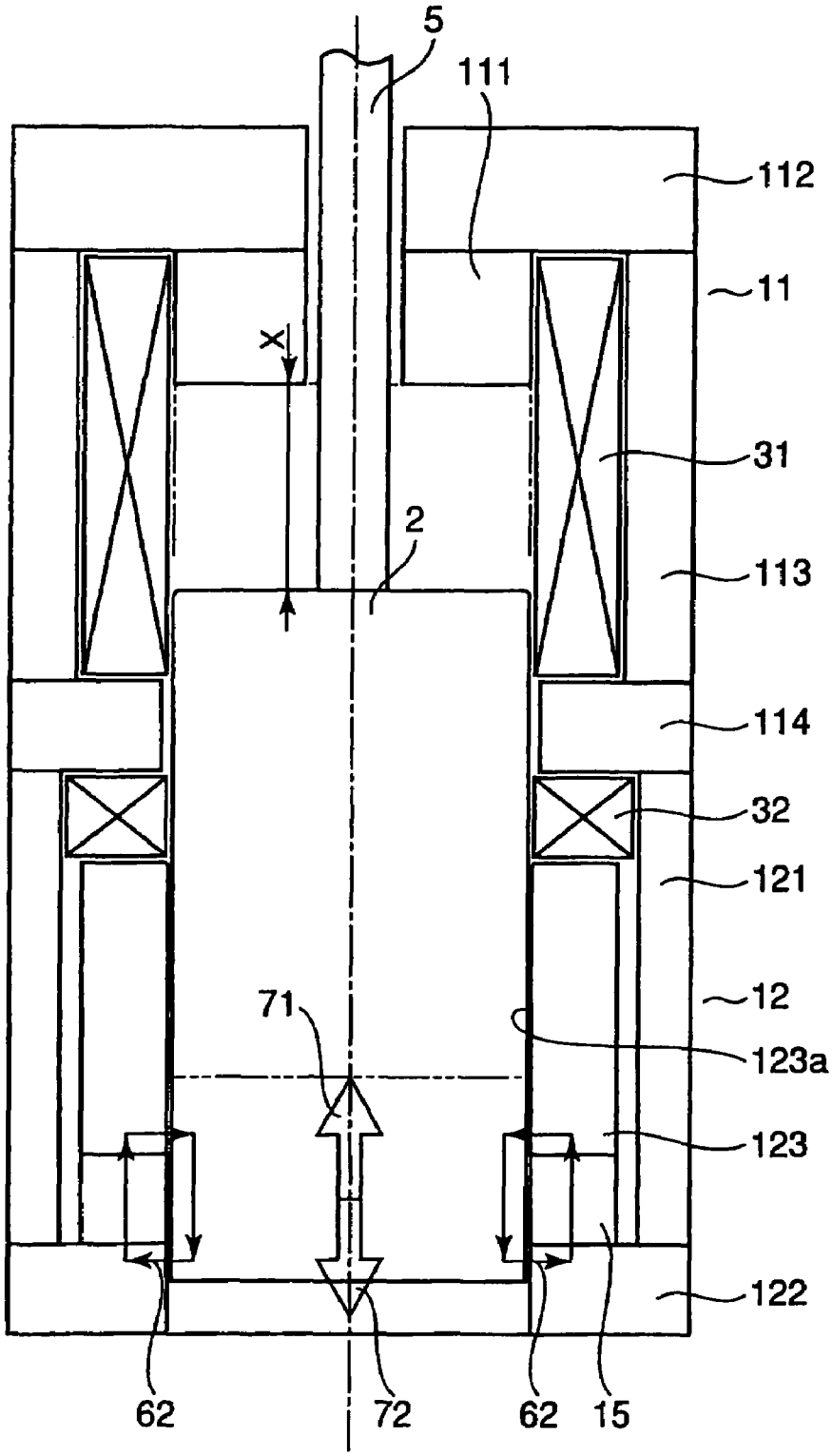
FIG. 30 is a cross section illustrating a sixth embodiment of an electromagnetic actuator according to the present invention.

FIG. 30 is a cross section of an electromagnetic actuator according to the sixth embodiment of the present invention and illustrates a released state.

The electromagnetic actuator comprises a first coil 31, a movable body 2 adapted to move over the central axis of the first coil 31, a first stator 11 which is disposed on the top and bottom faces and around the outer periphery as well as inside of the first coil 31 and constitutes, together with the movable body 2, a magnetic circuit for inducing magnetic flux generated from the first coil 31, a ring-shaped permanent magnet 15 provided concentrically with the first coil 31 at a predetermined distance from the first coil 31 so as to generate magnetic flux polarized in parallel to the driving direction of the movable body 2, and a second stator 12 connected with the first stator 11 and formed from an electromagnetic material for inducing the magnetic flux generated from the permanent magnet 15 into the movable body 2.

Among these components, the movable body 2 is composed of an electromagnetic material and is driven by the nonmagnetic shaft 5 attached to one end of the movable body 2.

The first stator 11 is constructed entirely with electromagnetic materials, and includes a convex pole piece 111 provided to extend upward from a point around the center of the first coil 31 to an upper end face, a first plate member 112 covering the upper end face of the first coil 31, a first cylinder 113 covering the outer periphery of the first coil 31, and a first hollow plate member 114 covering the bottom face of the first coil 31.

The second stator 12 is also constructed entirely with electromagnetic materials and includes a second cylinder 121 connected with the first hollow plate member 114 of the first stator 11, a second hollow plate member 122 attached to the second cylinder 121, and an internal cylinder 123 having an inner face 123*a* arranged adjacent to the outer periphery of the movable body 2 with a slight gap provided therebetween. The permanent magnet 15 is fixed between the second hollow plate member 122 and the internal cylinder 123.

Between the first hollow plate member 114 of the first stator 11 and the internal cylinder 123 of the second stator 12, a second coil 32 is provided to surround the movable body 2.

Next, the operation of this embodiment as constructed above will be described. As shown in FIG. 30, when the movable body 2 is moved away from the pole piece 111 and the permanent magnet 15 is in a position adjacent the lower end face of the movable body 2, the magnetic flux generated from the permanent magnet 15 passes through the magnetic material 2 having a less magnetoresistive property as shown by arrows 62. At this time, magnetic attracting forces 71, 72 respectively acting upward and downward on the movable body 2 due to the effect of the magnet 15 are balanced, thus holding the movable body 2 at a position where the gap between the movable body 2 and the pole piece 111 is defined by X.

Figure 31:
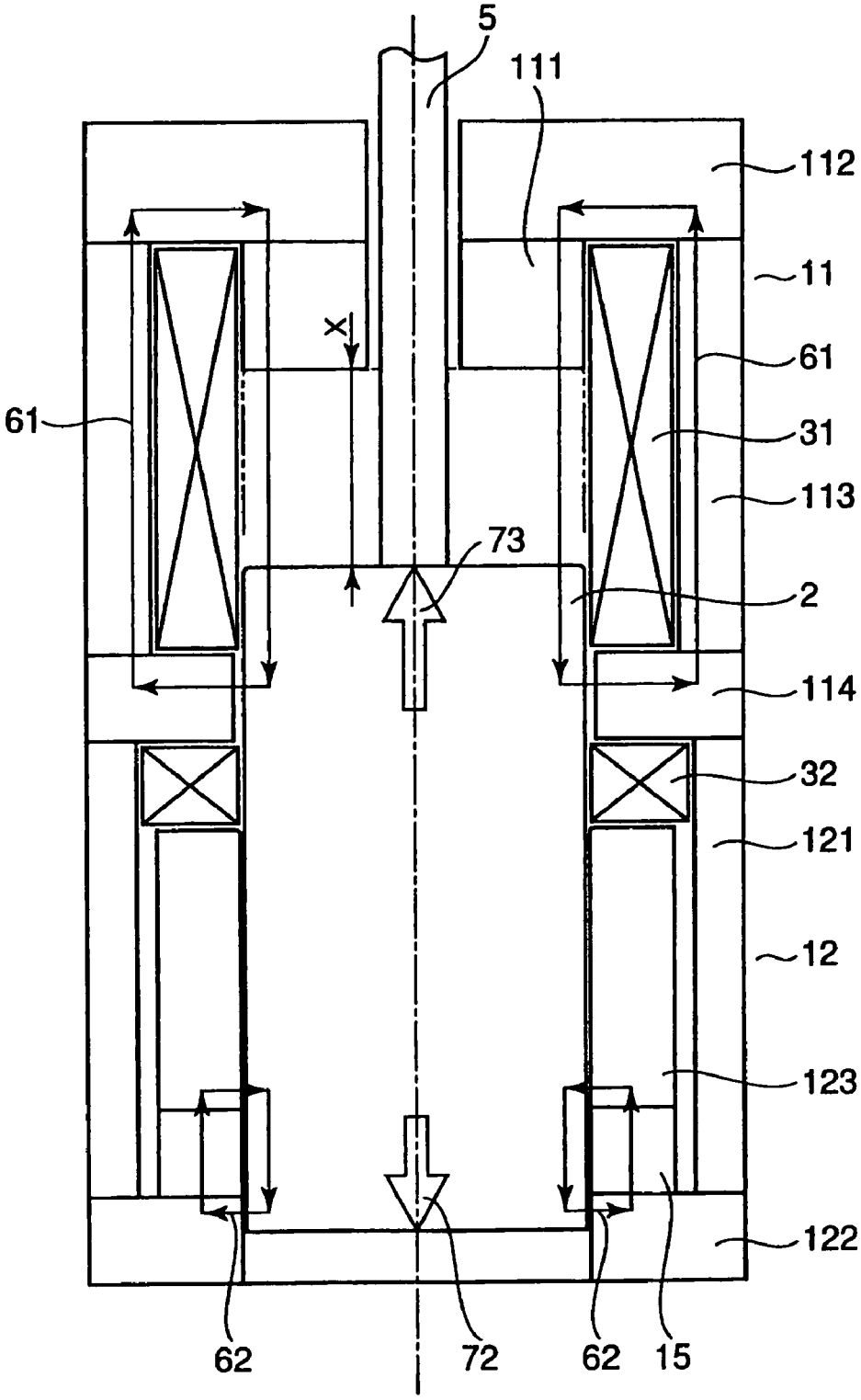
FIG. 31 is a diagram illustrating an operation through which a movable body is attracted to a pole piece by flowing an electric current through a first coil in the sixth embodiment of the present invention.

Next, an electric current flows in the first coil 31 in the state shown in FIG. 30 so as to generate the magnetic flux as shown by arrows 61 in FIG. 31. In this case, upwardly directed force 73 corresponding to the magnitude of the electric current flowed in the coil 31 acts on the movable body 2, thus the movable body 2 begins to rise. When the movable body 2 begins to rise, the balance between the magnetic attracting forces 71, 72 respectively acting upward and downward on the movable body 2 due to the effect of the permanent magnet 15 is broken down. Thus, the downwardly directed magnetic attracting force 72 is drastically increased depending on the amount of rise of the movable body 2, saturated at a level of the rise, thereafter drastically reduced upon further rising.

During the process, the amount of rise of the movable body 2 becomes quite minute. If the upwardly directed force 73 exceeds the saturated value of the downwardly directed force 72 generated from the permanent magnet 15, the movable body 2 rises until the gap X between the movable body 2 and the pole piece 111 becomes zero (FIG. 32).

Figure 32:
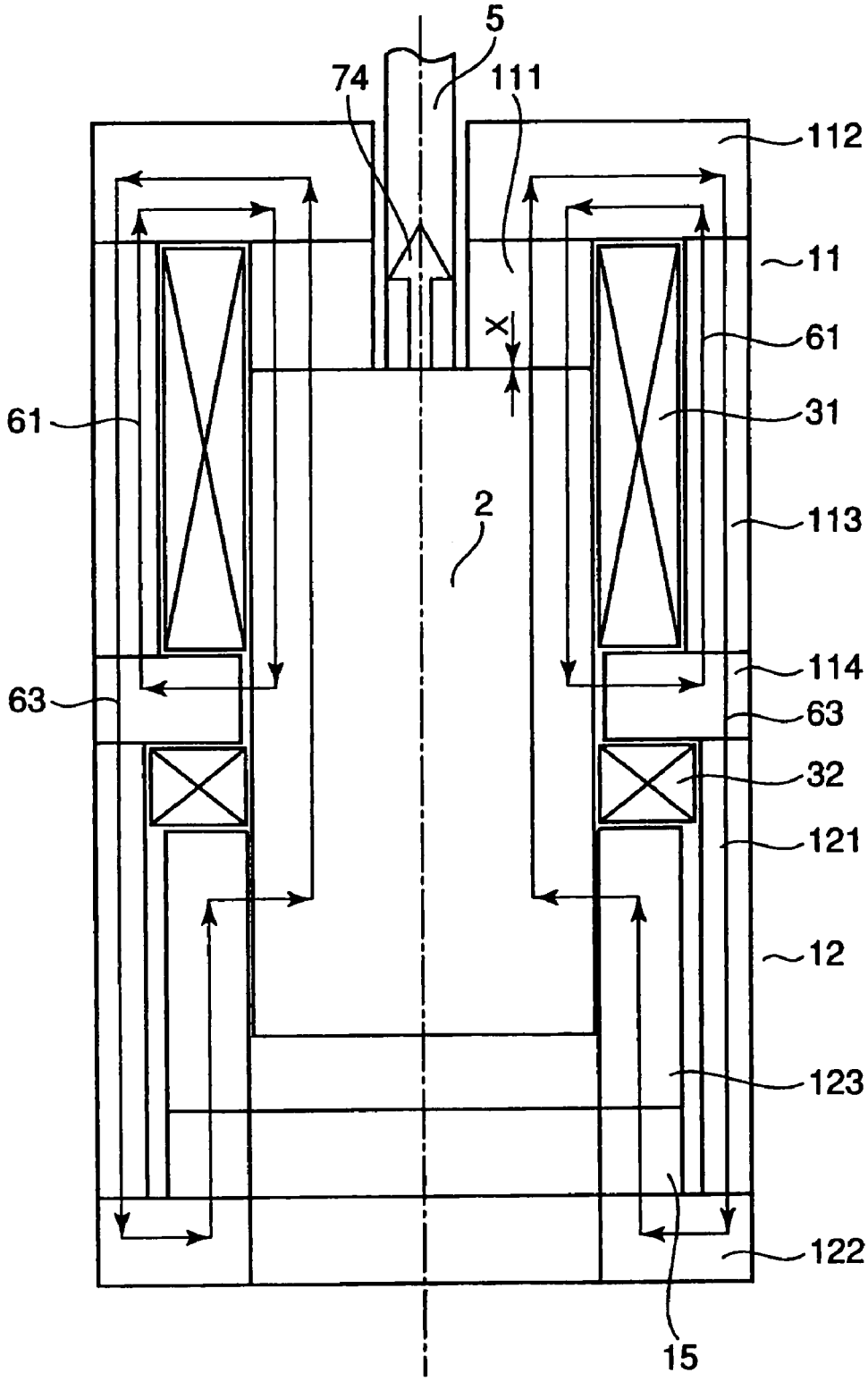
FIG. 32 is a diagram illustrating a state in which a movable body is actuated by flowing an electric current through the first coil and completely attracted to the pole piece in the sixth embodiment of the present invention.

FIG. 32 illustrates a state in which the gap X between the movable body 2 and the pole piece 111 is zero and the movable body 2 is hence attracted directly to the pole piece 111. In this state, the magnetic flux generated from the permanent magnet 15, as generally depicted by arrows 63, travels through the outer peripheral face of the movable body 2 from the internal cylinder 123, then into the end face of the pole piece 111, passes through the first plate member 112 of the first stator 11, first cylinder 113, first hollow plate member 114, second cylinder 121 of the second stator 12 and second hollow plate member 122, and thereafter returns to the permanent magnet 15. Accordingly, since the attracting force 74 due to the permanent magnet 15 acts on the end face of the movable body 2 as shown in the drawing, even if the electric current does no longer flow in the first coil 31, the movable body 2 remains attracted to the pole piece 111, as such maintaining the latched state.

Figure 33:
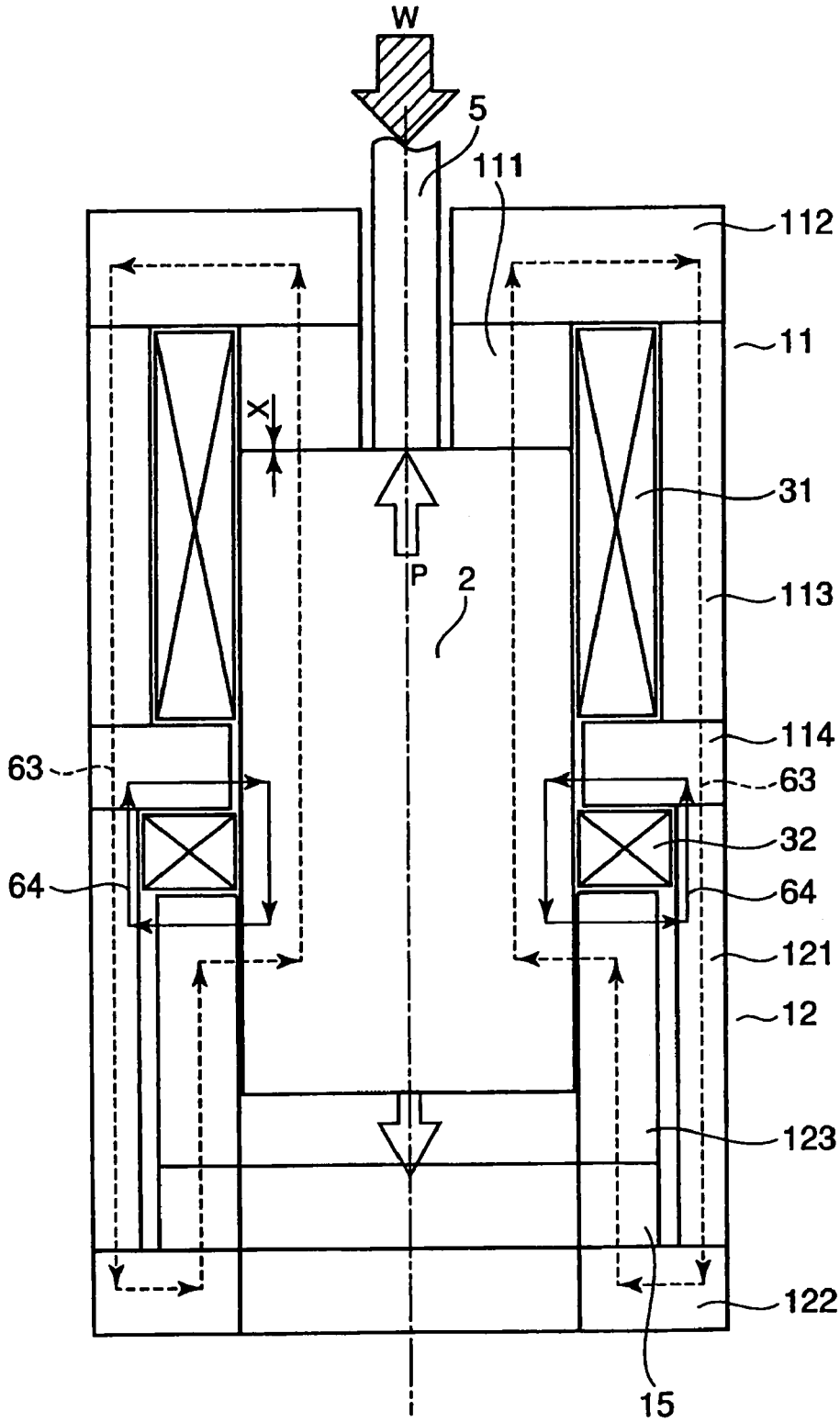
FIG. 33 is a diagram illustrating an operation through which the latched state is released by flowing an electric current through a second coil in the sixth embodiment of the present invention.

In the state shown in FIG. 32, as shown in FIG. 33, when the load W is applied on the shaft 5 of the movable body 2 and an electric current flows in the second coil 32 so as to cancel the magnetic flux of the permanent magnet 15 as shown by arrows 63, the magnetic flux generated from the permanent magnet 15 and passing through the movable body 2, first stator 11 and second stator 12 is reduced due to the magnetic flux generated from the second coil 32 as shown by arrows 64. Thus, the load W will exceed the attracting force P exerted on the movable body 2, thereby releasing the movable body 2 from the latched state and lowering the movable body 2.

As described above, according to this embodiment, the permanent magnet 15 is not inversely excited by the effect of magnetic flux to be generated from the first coil 31 and/or second coil 32 in either case. Additionally, since the permanent magnet 15, first coil 31 and second coil 32 are substantially surrounded by the first stator 11, second stator 12 and movable body 2 which are all formed from a ferromagnetic material or materials, the magnetic flux generated is not leaked away. Since the movable body 2 is operated by separately applying an electric current to the first coil 31 and second coil 32 which are independent of each other, the movable body can be operated by utilizing a simple power source, and the operational directions can be switched with ease at a high speed. Since the permanent magnet 15 is located to be near to the movable body 2 when the actuator is in a released state, the magnetic attracting force exerted on the movable body 2 can be maintained in a balanced state due to the magnetic flux from the permanent magnet 15 creating a magnetic circuit pass, together with the movable body 2, thereby holding the movable body 2 with a gap X provided relative to the pole piece 111.

As described above, the electromagnetic actuator comprises the first coil 31, the movable body 2 adapted to move over the central axis of the first coil 31, the first stator 11 which is provided on the top and bottom faces and around the outer periphery of the first coil 31, and the permanent magnet 15 adapted to firmly latch the movable body 2 by forcing it to be attracted to the first stator 11 at its operational end position. The permanent magnet 15 is located to be near to the movable body 2 when the movable body 2 is in a released end position which is apart from the first stator 11. Therefore, the movable body 2 can be held by the magnetic force generated from the permanent magnet 15 with the movable body 2 positioned at the operational end point. When releasing the movable body 2 positioned at the operational end point, the permanent magnet 15 is not inversely excited or demagnetized directly, and the leakage of the magnetic flux due to the permanent magnet 15 and/or the first coil 31 can be reduced.

Seventh Embodiment

Next, a seventh embodiment of the present invention will be described with reference to FIGS. 34 to 37. In the seventh embodiment shown in FIGS. 34 to 37, like parts in the first embodiment shown in FIGS. 1 to 7 are respectively designated by the same reference numerals or characters, and detailed descriptions for those parts are omitted here.

Figure 34:
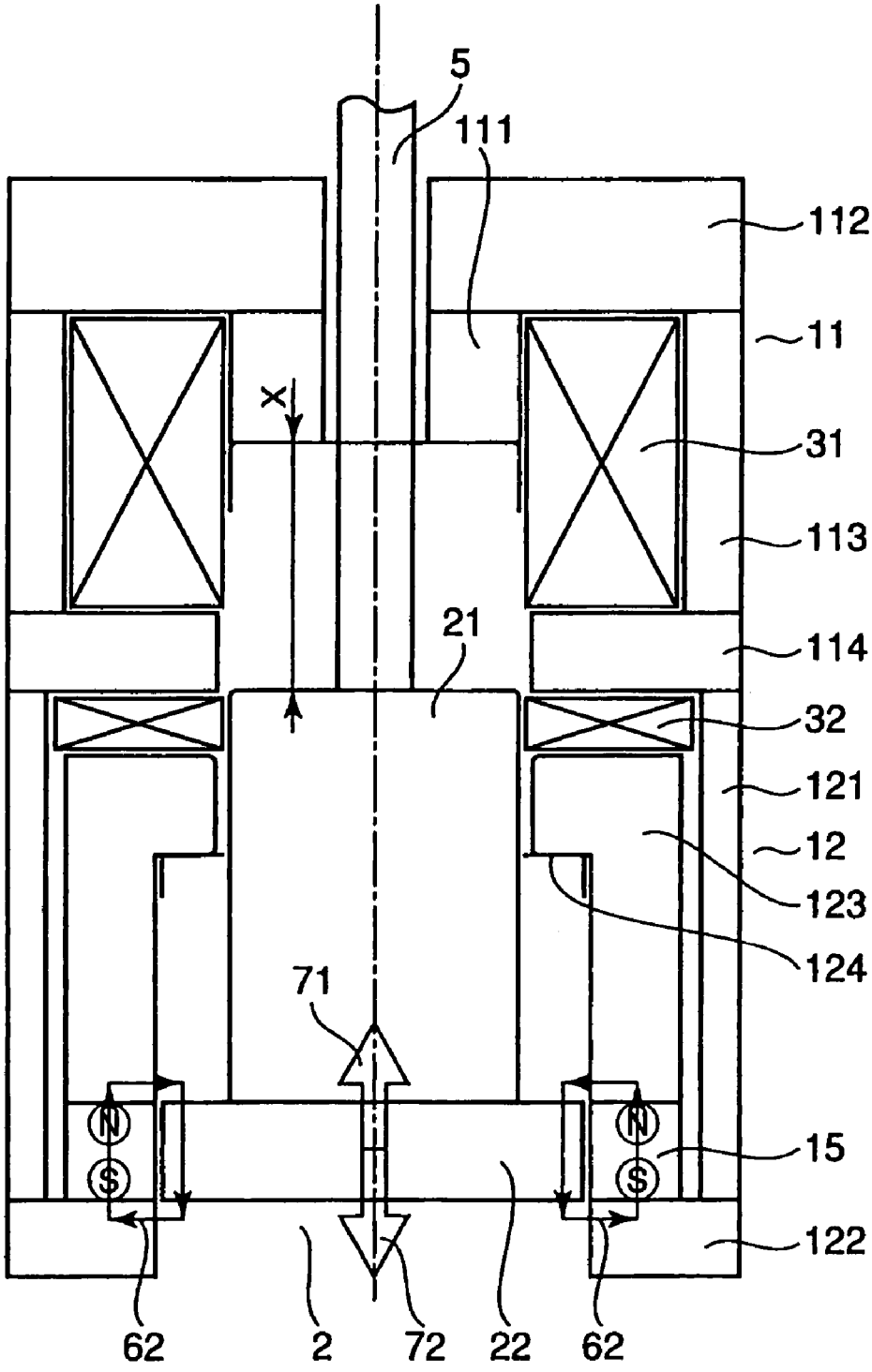
FIG. 34 is a cross section illustrating a seventh embodiment of an electromagnetic actuator according to the present invention.

FIG. 34 is a cross section of an electromagnetic actuator according to the sixth embodiment of the present invention and illustrates a released state.

The movable body 2 is composed of an electromagnetic material, and includes the plunger 21 adapted to move on the central axis of the first coil 31 and formed from a magnetic material, and the projecting plate member 22 disposed on one side of the plunger 21 opposite to the shaft 5 and projecting radially outward from the plunger 21. The difference between the thickness of the projecting plate member 22 and the thickness of the permanent magnet 15 is within the range of ±15% of the projecting plate member 22.

Among the components of the second stator 12, while the second cylinder 121 and the hollow plate member 122 have the same constructions as those in the first embodiment respectively, the internal cylinder 123 has a two-stepped cylindrical shape including the receiving portion 124 which forms a stepped portion.

When the plunger 21 is in contact with the pole piece 111, the projecting plate member 22 of the movable body 2 is in contact with the receiving portion 124 of the internal cylinder 123.

For example, the permanent magnet 15 is arranged such that the north (N) pole faces upward while the south (S) pole faces downward. In this case, when the projecting plate member 22 of the movable body 2 is away form the magnet 15, the S pole appears at the pole piece 111 while the N pole appears at the receiving portion 124 of the cylinder 123. Thus, the movable body 2 is attracted in the latched state by both the N and S poles when the projecting plate member 22 of the movable body 2 is in a position near to the magnet 15.

Next, the operation of this embodiment constructed as described above will be explained.

In FIG. 34, the plunger 21 of the movable body 2 is moved away from the pole piece 111 while the projecting plate member 22 of the movable body 2 is in a position adjacent the permanent magnet 15. At this time, the magnetic flux generated from the permanent magnet 15 passes, as shown by arrows 62, through the projecting plate member 22 of the magnetic material 2 formed from a magnetic material having a less magnetoresistive property. As a result, magnetic attracting forces 71, 72 respectively acting upward and downward on the movable body 2 due to the effect of the magnet 15 are balanced, thus holding the movable body 2 at a position where the gap between the movable body 2 and the pole piece 111 is defined by X.

Figure 35:
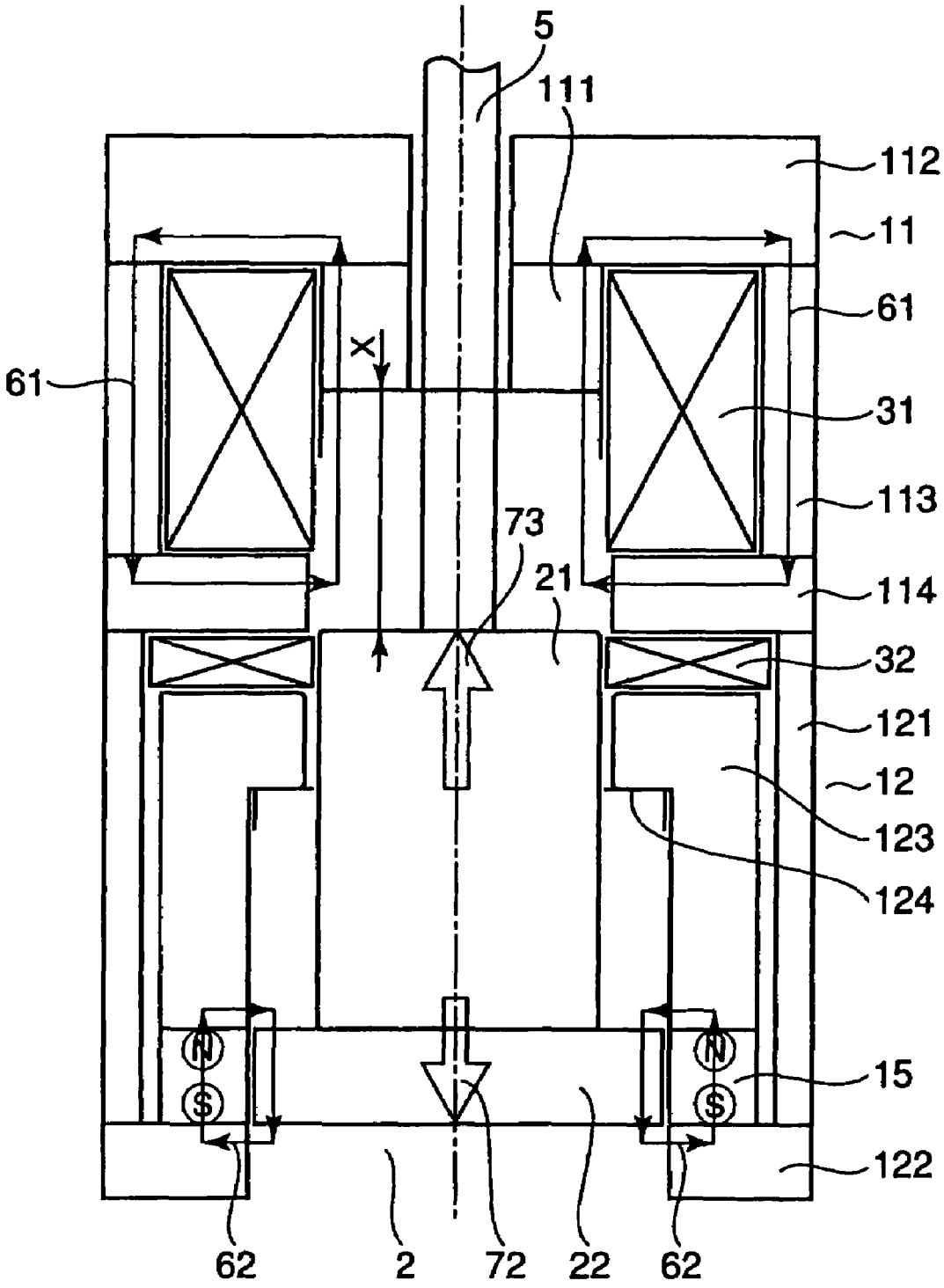
FIG. 35 is a diagram illustrating an operation through which a movable body is attracted to a pole piece by flowing an electric current through a first coil in the seventh embodiment of the present invention.

Next, an electric current flows in the first coil 31 in the state shown in FIG. 34 so as to generate the magnetic flux as shown by arrows 61 in FIG. 35. In this case, upwardly directed force 73 corresponding to the magnitude of the electric current flowing in the coil 31 acts on the movable body 2, thus the movable body 2 begins to rise. When the movable body 2 begins to rise, the balance between the magnetic attracting forces 71, 72 respectively acting upward and downward on the movable body 2 due to the effect of the permanent magnet 15 is broken down. Thus, the downwardly directed magnetic attracting force 72 is drastically increased depending on the amount of rise of the movable body 2, saturated at a level of the rise, thereafter drastically reduced upon further rising.

During the process, the amount of rise of the movable body 2 becomes quite minute. If the upwardly directed force 73 exceeds the saturated value of the downwardly directed force 72 generated from the permanent magnet 15, the movable body 2 rises until the gap X between the movable body 2 and the pole piece 111 becomes zero (FIG. 36).

Figure 36:
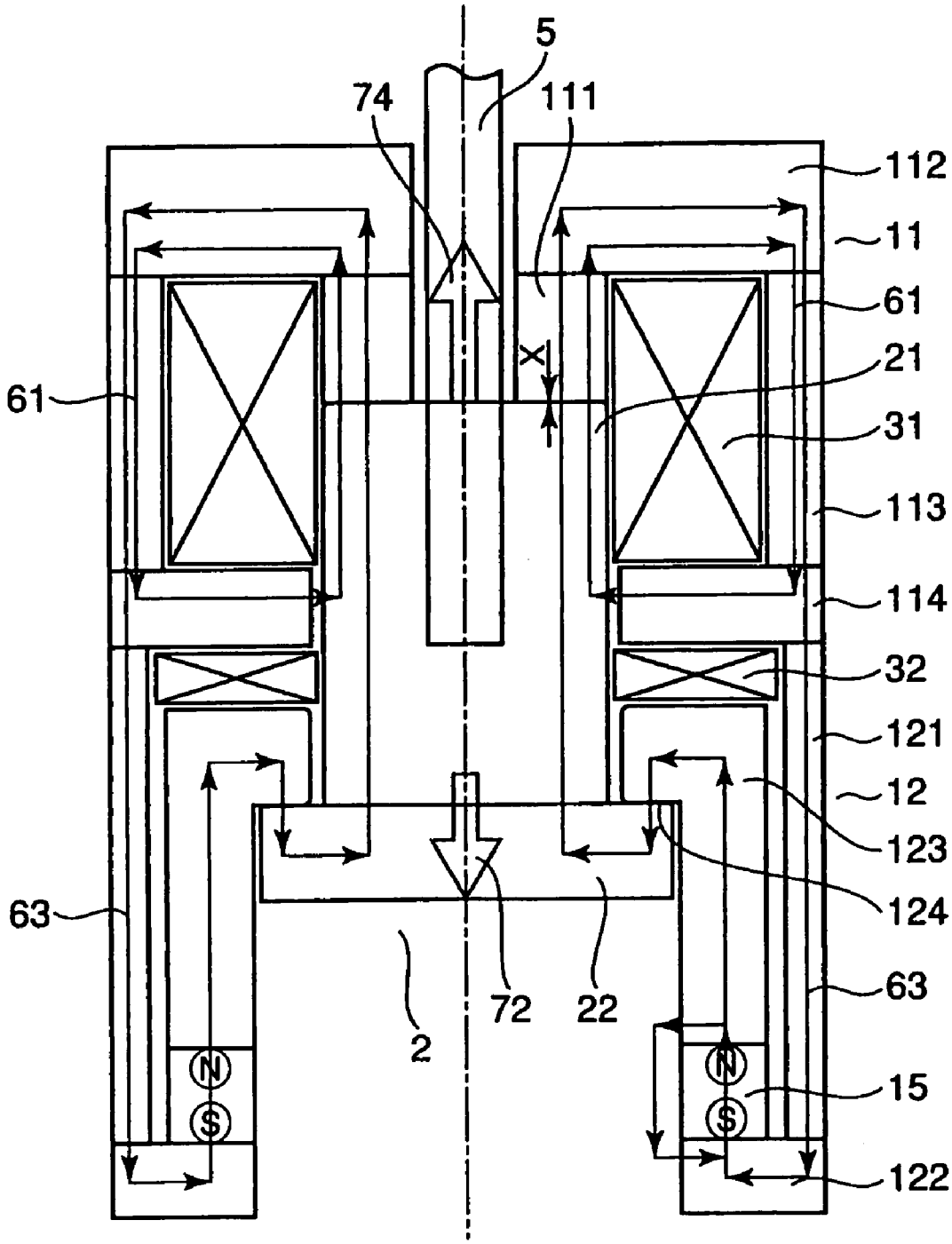
FIG. 36 is a diagram illustrating a state in which a movable body is driven by flowing an electric current through the first coil and completely attracted to the pole piece in the seventh embodiment of the present invention.

FIG. 36 illustrates a state in which the gap X between the movable body 2 and the pole piece 111 is zero and the movable body 2 is hence attracted directly to the pole piece 111. In this state, the magnetic flux generated from the permanent magnet 15, as generally depicted by arrows 63, travels through the projecting plate member 22 of the movable body 2 from the receiving portion 124 of the internal cylinder 123, then into the end face of the pole piece 111 from the plunger 21, passes through the first plate member 112 of the first stator 11, first cylinder 113, first hollow plate member 114, second cylinder 121 of the second stator 12 and second hollow plate member 122, and thereafter returns to the permanent magnet 15. Accordingly, since the attracting force 74 due to the permanent magnet 15 acts on the end face of the plunger 21 and the contact face defined between the projecting plate member 22 and the receiving portion 124, even if the electric current does no longer flow in the first coil 31, the plunger 21 remains attached to the pole piece 111 as well as the plate member 22 of the movable body 2 remains attracted to the receiving portion 124 of the cylinder 123, respectively.

Figure 37:
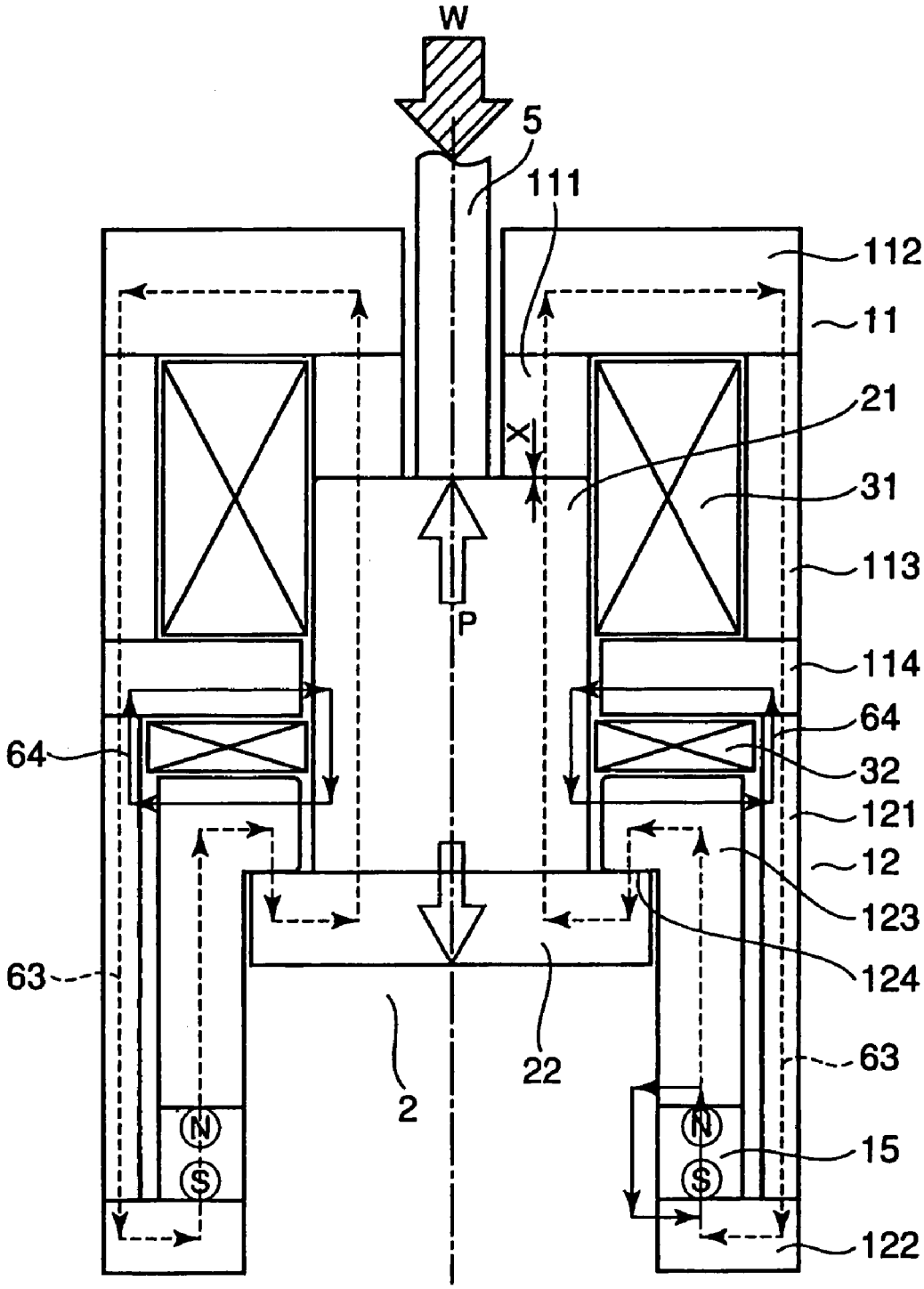
FIG. 37 is a diagram illustrating an operation through which the latched state is released by flowing an electric current through a second coil in the seventh embodiment of the present invention.
Figure 38:
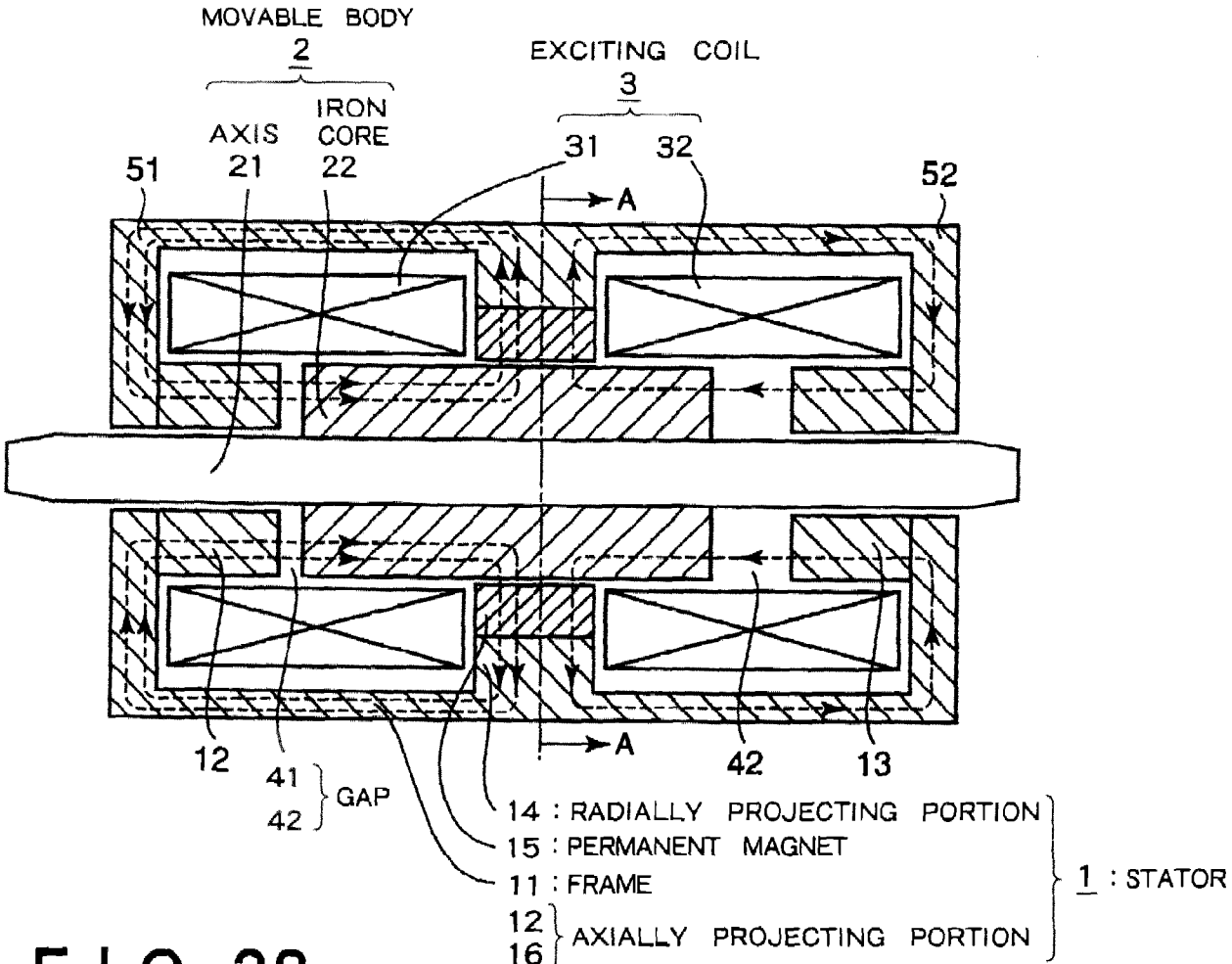
FIG. 38 is a cross section illustrating a conventional electromagnetic actuator.
Figure 39:
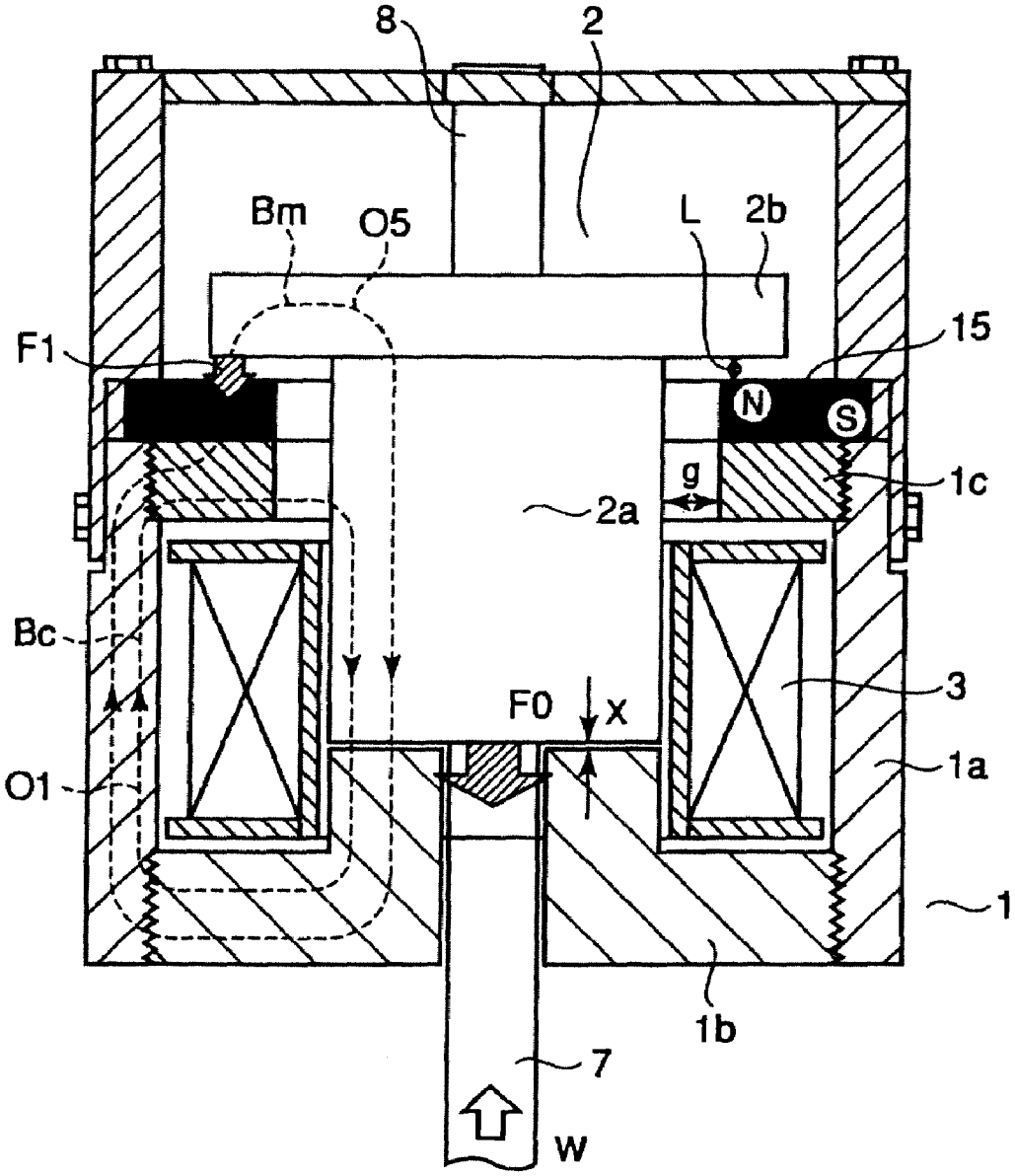
FIG. 39 is a cross section illustrating a conventional electromagnetic actuator.

In the state shown in FIG. 36, as shown in FIG. 37, when the load W is applied on the shaft 5 of the movable body 2 and an electric current flows in the second coil 32 so as to cancel the magnetic flux of the permanent magnet 15 as shown by arrows 63, the magnetic flux generated from the permanent magnet 15 and passing through the movable body 2, first stator 11 and second stator 12 is reduced due to the magnetic flux generated from the second coil 32 as shown by arrows 64. As a result, the load W will exceed the attracting force P exerted on the movable body 2, thereby releasing the movable body 2 from the latched state and lowering the movable body 2.

As described above, according to this embodiment, the permanent magnet 15 is not inversely excited by the effect of magnetic flux to be generated from the first coil 31 and/or second coil 32 in either case. Additionally, since the permanent magnet 15, first coil 31 and second coil 32 are substantially surrounded by the first stator 11, second stator 12 and movable body 2 which are all formed from a ferromagnetic material or materials, the magnetic flux generated is not leaked away. Since the movable body 2 is operated by separately applying an electric current to the first coil 31 and second coil 32 which are independent of each other, the movable body can be operated by utilizing a simple power source, and the operational directions can be switched with ease at a high speed. Since the permanent magnet 15 is located to be near to the movable body 2 when the actuator is in a released state, the magnetic attracting force exerted on the movable body 2 can be maintained in a balanced state due to the magnetic flux from the permanent magnet 15 creating a magnetic circuit pass together with the movable body 2, thereby holding the movable body 2 with a gap X provided relative to the pole piece 111.

The invention claimed is:

1. An electromagnetic actuator, comprising:

a first coil;

a cylindrical movable body adapted to move along the central axis of the first coil;

a first stator including a first plate member provided on the top face of the first coil, a first hollow plate member provided on the bottom face of the first coil, and a first cylinder covering the outer periphery of the first coil;

a permanent magnet adapted to fix securely the cylindrical movable body at an end point of its movement; and a second stator provided in succession with the first stator and adapted to control the magnetic flux of the permanent magnet, wherein the second stator includes a second cylinder provided in succession with the first hollow plate member of the first stator, a second hollow plate member provided at one end on the side of the permanent magnet, and an internal cylinder disposed in the second cylinder, the permanent magnet is provided outside the stroke area of the cylindrical movable body so that the permanent magnet can not come in contact with the cylindrical movable body, and when the movable body is in a latched state against the outer load, the magnetic flux generated from the permanent magnet forms a magnetic circuit pass in a closed manner which is defined through the first plate member, the first cylinder, the first hollow plate member, the second cylinder, the second hollow plate member, the permanent magnet, the internal cylinder, and the cylindrical movable body without any air space.

2. The electromagnetic actuator according to claim 1, wherein the cylindrical movable body includes a plunger, and a projecting plate member projecting radially outward from the plunger, and wherein a receiving portion for receiving the projecting plate member is provided at the internal cylinder.

3. The electromagnetic actuator according to claim 1, wherein a short ring adapted to make the magnetic flux of the permanent magnet short is provided in the vicinity of the permanent magnet.

4. The electromagnetic actuator according to claim 1, wherein a pole piece connected with the first plate member is provided at the center of the first coil.

5. The electromagnetic actuator according to claim 4, wherein the length of the pole piece is set within the range of from a maximum length to reach the center of the first coil to a minimum length shortened by half of a stroke X of the cylindrical movable body as compared to the maximum length.

6. The electromagnetic actuator according to claim 4, wherein the difference between the outer diameter of the cylindrical movable body and the outer diameter of the pole piece is within the range of ±15% of the outer diameter of the cylindrical movable body.

7. The electromagnetic actuator according to claim 4, wherein the difference between the cross section area of the cylindrical movable body and the cross section area of the pole piece is within the range of ±15% of the cross section area of the cylindrical movable body.

8. The electromagnetic actuator according to claim 1, wherein the cylindrical cross section area of the first plate member which has the same diameter as the outer diameter of the cylindrical movable body is the same as or less than twice the cross section area of the cylindrical movable body.

9. The electromagnetic actuator according to claim 1, wherein the cross section area of the first cylinder covering the outer periphery of the first coil is the same as or less than twice the cross section area of the cylindrical movable body.

10. The electromagnetic actuator according to claim 1, wherein the difference between the cross section area of the inner hollow face of the first hollow plate member and the cross section area of the movable body is within the range of ±15% of the cross section area of the inner hollow face of the first hollow plate member.

11. The electromagnetic actuator according to claim 1, wherein the difference between the cross section area of the second stator which is perpendicular to the magnetic flux of the permanent magnet and the cross section area of the permanent magnet is within the range of ±15% of the cross section of the second stator.

12. The electromagnetic actuator according to claim 1, wherein a gap defined between the first coil and the first stator is 3 mm or less.

13. The electromagnetic actuator according to claim 1, wherein a gap defined between the inner hollow face of the first hollow plate member of the first stator and the outer peripheral face of the cylindrical movable body is within the range of from 3 mm to 5 mm.

14. The electromagnetic actuator according to claim 2, wherein the difference between the cross section area of the projecting plate member of the cylindrical movable body and the cross section area of the plunger is within the range of ±15% of the cross section area of the projecting plate member.

15. The electromagnetic actuator according to claim 2, wherein the difference between the cross section area of the projecting plate member of the cylindrical movable body and the cross section area of the inner peripheral face of the receiving portion of the second cylinder is within the range of ±15% of the cross section area of the projecting plate member.

16. The electromagnetic actuator according to claim 2, wherein a gap between the outer peripheral face of the plunger of the cylindrical movable body and the second stator is within the range of from 1 mm to 5 mm.

17. The electromagnetic actuator according to claim 1, wherein a second coil is provided coaxially with the first coil.

18. The electromagnetic actuator according to claim 17, wherein the first coil and the second coil are juxtaposed with each other in the radial direction.

* * * * *